US006382658B1

(12) United States Patent
Stubblefield

(10) Patent No.: US 6,382,658 B1
(45) **Date of Patent: *May 7, 2002**

(54) METHOD OF MAKING A SNOWBOARD HAVING IMPROVED TURNING PERFORMANCE

(75) Inventor: Donald P. Stubblefield, Beaverton, OR (US)

(73) Assignee: North Shore Partners, Lake Oswego, OR (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/253,649

(22) Filed: Feb. 20, 1999

Related U.S. Application Data

(63) Continuation-in-part of application No. 08/974,287, filed on Nov. 19, 1997.

(51) Int. Cl.[7] ..... A63C 5/04
(52) U.S. Cl. ..... 280/609; 280/601; 280/602
(58) Field of Search ..... 280/14.2, 609, 280/607, 601, 602, 22

(56) References Cited

U.S. PATENT DOCUMENTS

| | | | | |
|---|---|---|---|---|
| 2,318,147 A | | 5/1943 | Ericson | |
| 4,163,565 A | | 8/1979 | Weber | |
| 4,974,868 A | | 12/1990 | Morris | |
| 4,995,631 A | | 2/1991 | Hunter | |
| 5,018,760 A | | 5/1991 | Remondet | |
| 5,261,689 A | | 11/1993 | Carpenter et al. | |
| 5,292,148 A | * | 3/1994 | Abondance et al. | 280/602 |
| 5,413,371 A | | 5/1995 | Trimble | |
| 5,462,304 A | | 10/1995 | Nyman | |
| 5,464,242 A | | 11/1995 | Commier et al. | |
| 5,573,264 A | | 11/1996 | Deville et al. | |
| 5,823,562 A | * | 10/1998 | Stubblefield | 280/609 |
| 5,954,356 A | * | 9/1999 | Busby, Jr. et al. | 280/602 |
| 5,988,668 A | * | 11/1999 | DeVille et al. | 280/602 |

FOREIGN PATENT DOCUMENTS

| | | |
|---|---|---|
| DE | G9217464 U | 2/1993 |
| DE | 4207768 A | 9/1993 |
| FR | 2704155 A | 10/1994 |

* cited by examiner

*Primary Examiner*—Robert P. Olszewski
*Assistant Examiner*—Michael Cuff
(74) *Attorney, Agent, or Firm*—SAIDMAN DesignLaw Group

(57) ABSTRACT

A method of making a snowboard or ski so that the bottom surface of the snowboard or ski is capable of bowing into a desired longitudinal curvature, with a circular arc being the preferred shape, in order to enable a "perfect" turn to be carved. The method comprises the steps of selecting a desired longitudinal curvature of the snowboard during turns, determining the desired curvature of the snowboard at a plurality of cross-sectional portions thereof in order to achieve the desired curvature, and selecting the cross-sectional area moments of inertia at each of the plurality of cross-sections to provide the desired curvature. The thickness of the core of the snowboard is the preferred design variable. The center section of a snowboard designed in accordance with this method has smaller average area moment of inertia than one or both of the front and rear mounting zones. Snowboards designed and constructed in accordance with this method exhibit improved turning performance, particularly in sharp, tight turns.

8 Claims, 16 Drawing Sheets

METHOD OF MAKING A SNOWBOARD HAVING IMPROVED TURNING PERFORMANCE

CROSS-REFERENCE TO RELATED APPLICATION

This application is a continuation-in-part of my prior U.S. patent application Ser. No. 08/974,287, filed Nov. 19, 1997.

BACKGROUND OF THE INVENTION

1. Field of the Invention

This invention relates to snowboards and, more particularly, is directed to a snowboard designed with the goal of carving an ideal or "perfect" turn during use.

2. Description of Related Art

This portion of the specification is divided for ease in understanding into the following 3 sections:

A. The Deficiencies of Conventional Snowboard Design

B. The Prior Art

C. General Snowboard Structure

A. The Deficiencies of Conventional Snowboard Design

In order to initiate a turn (also called "carving" a turn), a skier or snowboarder applies pressure to the ski or snowboard in a manner that rotates the ski or snowboard about its longitudinal axis, tilting the ski or snowboard up onto one of its edges (often called the "riding edge") and deflecting the ski or snowboard away from the skier or snowboarder. Ideally, the riding edge of the ski or snowboard will create a single slender cut into the snow as the skier or snowboarder carves the turn (called an "ideal turn"). This type of turn is desirable because it minimizes the friction or drag on the ski or snowboard as it moves through the turn. In addition, this type of turn is the easiest to control. However, as will be fully explained below, this type of turn has been impossible to achieve with conventional snowboard design.

Snowboards were initially manufactured by ski manufacturers, and most of the initial designers of snowboards were therefore ski designers who understandably borrowed heavily from the accepted wisdom of the ski industry. As a consequence, there are many similarities today between skis and snowboards. For example, both skis and snowboards use essentially the same materials, e.g., fiberglass ultra high molecular weight polyethylenes, either singly or in laminated combinations with wood cores, steel edges, and plastic tops and sidewalls. Also, ski construction, e.g., sidewall, sandwich or capped construction, and techniques of manufacture, e.g., presses, composites and laminating, were transferred virtually unchanged to snowboards.

Of importance to the present invention is the way in which skis, and therefore conventional snowboards, flex longitudinally when in use. Trimble et al. (U.S. Pat. No. 5,413,371) disclose that conventional skis form a "U-shaped" curve when in use. A skier using a ski that forms a U-shaped curve when in use will be able to carve a turn that approaches an ideal turn without a great deal of difficulty. This is primarily because only one of the skier's feet is positioned on each ski, thereby applying a single, centrally positioned load onto each ski.

In addition, nearly all skis (and therefore conventional snowboards) include a single camber. As a result, when under little or no downward loading, skis rest on two riding areas, one near the nose of the ski and one near the tail of the ski; the portion of the riding edge between these two riding areas does not contact the snow. When making a turn under rider-induced loading, the entire riding edge is conventionally designed to make contact with the snow. See, e.g., John G. Howe, *Skiing Mechanics* 108–110 ($1^{ST}$ ed. 1983). This has traditionally been accomplished by using side cuts.

Under conventional ski design principles, the relative stiffness of each portion of the ski along its length is considered to be of little importance to its turning characteristics. Significantly, conventional ski design fails to account for the longitudinal shape of the ski when downward loading increases beyond the point at which the riding edge of the ski fully contacts the snow. In other words, conventional ski design focuses simply on ensuring that the riding edge fully contacts the snow, thereby ignoring how the ski bends during turns. In reality, a ski does not stop downwardly flexing once the riding edge makes contact with the snow surface. Under ordinary conditions, the ski continues to flex, both displacing and compressing the snow and forming a downwardly arched curve.

Merely designing a snowboard or ski so that its riding edge fully contacts the snow during turns, while ignoring the shape the board or ski bends into beyond the point at which the riding edge fully contacts the snow, results in poor turning performance, especially in sharp, tight turns.

In fact, it is nearly impossible for a snowboarder to carve an ideal turn on a conventionally designed snowboard (a snowboarder is carving an ideal turn, or is at least approaching an ideal turn, when the back portion of the snowboard follows substantially the same track as the front portion of the board).

Several factors contribute to the poor turning performance of conventional snowboards. First, in contrast to a skier, both of the snowboarder's feet are positioned on the snowboard. Thus the snowboarder applies two non-centrally located loads onto the snowboard during a turn. The application of two non-centrally located loads to a conventional snowboard (which is typically stiffest in its center section) results in a large flattened area in the center section of the snowboard. Consequently, it is very common for the back half of the snowboard to cut its own path through the snow during a turn (sometimes called "plowing"), rather than tracking the path made by the front half. Plowing is most pronounced during sharp turns and is undesirable because it makes the snowboard more difficult to control in turns and greatly increases the friction or drag on the snowboard as it moves through the snow.

Use of side cuts improves the flexibility of the central portion of a snowboard slightly, but far from overcomes the deficiencies of conventional snowboards. In addition, most prior art snowboards have a single camber. As explained in my prior U.S. Pat. No. 5,823,562, a snowboard having a single camber is difficult to control regardless of the longitudinal flexibility of the snowboard.

Finally, to design a snowboard merely so that its riding edge makes full contact with the surface when turning fails to take into account subsequent flexing of the snowboard.

B. Third Prior Art

Representative of the prior art snowboards are Remondet, U.S. Pat. No. 5,018,760, Carpenter et al., U.S. Pat. No. 5,261,689, Nyman, U.S. Pat. No. 5,462,304, and Deville et al., U.S. Pat. No. 5,573,264.

Remondet shows (FIG. 4) a snowboard having a thickness that is at a maximum in the center of the snowboard, gradually diminishes towards the tail and nose portions of the snowboard. Thus, the center section is the stiffest portion of the snowboard. A snowboard designed in this manner is most susceptible to plowing.

Carpenter et al. show (FIG. 1) a snowboard having thinner fore and aft sections separated by a thicker central platform having an essentially constant thickness. While a snowboard designed in accordance with the teachings of Carpenter et al. will be easier to control in turns than Remondet's snowboard, plowing is still a substantial problem.

Nyman shows (FIG. 2) a snowboard having a single camber and an essentially constant thickness from nose to tail (it is not clear whether the constant thickness is an intended characteristic of Nyman's snowboard, or whether it is merely the draftsman's contribution, for the thickness of the snowboard is not mentioned in his specification). Nyman's snowboard may be a slight improvement over Remondet and Carpenter et al., however, its center section will still remain relatively flat during turns, and therefore, is susceptible to plowing.

Deville et al. disclose a snowboard with a core having a constant thickness in which the torsional and longitudinal stiffness characteristics of the snowboard can be more precisely selected by adding reinforcing members to the surface of the snowboard in various patterns. Deville et al. teach providing less reinforcement in the central portion of the snowboard than within the boot mounting zones. This concept likely improves the turning characteristics of Deville et al.'s snowboard in relation to the prior art; however, its performance undoubtedly leaves much to be desired. In addition, adding reinforcements to the structure of a snowboard as taught by Deville et al. creates stress concentrations within the snowboard, thereby decreasing the performance of the snowboard and increasing the likelihood of structural failure. Finally, Deville et al. mention that such reinforcements could be incorporated within the "base structure" of the snowboard, but do not show nor explain how this would be accomplished.

C. General Snowboard Structure

In order to better appreciate the present invention, it is believed that an explanation of general snowboard structure would be helpful.

Referring first to FIG. 1, there is illustrated a top view of a snowboard indicated generally by reference numeral 10. Snowboard 10 has a nose 12, a tail 14, and a body 16 that extends between nose 12 and tail 14.

Although snowboard 10 will be described as being formed of separate regions, areas, zones, sections, portions, segments, etc. as if they are separate entities, such discussion is merely for the purpose of clarity, as snowboard 10 is, in fact, an integral structure from nose 12 to tail 14.

Body 16 generally includes a bottom surface 18 (not shown in this view), a top surface 20, a front portion 22 and a rear portion 26. Body 16 has an effective length 17 that corresponds to the portion of bottom surface 18 which contacts the snow when snowboard 10 is in use. The midpoint of body 16 is indicated generally by dashed line 19, while the midpoints of front and rear portions 22 and 26 are respectively indicated by dashed lines 23 and 27.

Top surface 20 of body 16 includes a front mounting zone 24 and a rear mounting zone 28, both generally indicated within the area of broken lines MZ. Front and rear mounting zones 24 and 28 are separated by a center section indicated generally by reference numeral 30. Front and rear mounting zones 24 and 28 are those areas in which conventional front and rear snowboard bindings (not shown) are respectively mounted when the snowboard 10 is in use. Front mounting zone 24 preferably encompasses the midpoint 23 of front portion 22, while rear mounting zone 28 preferably encompasses midpoint 27 of rear portion 28. Front and rear mounting zones 24 and 28 are located in these general areas in such a manner as to accommodate the height and snowboarding style of the range of riders for which the particular board is designed.

As is well-known in the art, snowboard 10 is typically designed to accommodate a pair of snowboard bindings mounted within front and rear mounting zones 24 and 28, each such binding adapted to secure one of the riders'boots to snowboard 10 during use. Each snowboard binding includes, generally, a boot bed to provide a stable surface for the boot to rest upon, means for securing the boot to the binding (such as straps, laces, or buckles), and means for securing the binding to top surface 20 of body 16 (none of the bindings'parts are illustrated).

The conventional method for securing each binding to snowboard 10 is to provide four rows of threaded inserts, each row preferably having 2 inserts. illustrated in FIG. 1 is a first set of four rows of threaded inserts 25, 29, 31 and 33 that are respectively transversely aligned across and embedded into top surface 20 of body 16 in front mounting zone 24. Similarly, a second set of four rows of threaded inserts 25', 29', 31' and 33' are transversely aligned across and embedded into top surface 20 in rear mounting zone 28. Two rows of inserts typically secure each snowboard binding; thus, inserts 25 and 29 may be selected by the user to secure the front binding, while inserts 29' and 31' may be selected to secure the rear binding. Other sets of inserts may, of course, be selected as desired.

The front and rear bindings each preferably include a plurality of mounting apertures (also not shown) adapted to mate with the inserts in each row. Typically, each binding is placed in position (with each mounting aperture being aligned with an insert), then the binding is bolted or screwed to the inserts. The distance between the rows of inserts that secure the front binding in front mounting zone 24 and the selected rows of inserts that secure the rear binding in rear mounting zone 28 is preferably selected so that the intended rider's boots are separated by a distance approximately equal to the rider's shoulders. For most riders, this spacing provides the most stable and comfortable riding stance.

Thus, it may be appreciated that conventionally the first and fourth rows of inserts 25 and 33 generally define the forward and rear boundaries of front mounting zone 24, while the rows of inserts 25' and 33' generally define the forward and rear boundaries of rear mounting zone 28. The center section 30 is located between the rows of inserts 33 and 25'.

While the use of threaded inserts is presently the standard means for securing bindings to snowboard 10, obviously bindings could be secured to top surface 20 of body 16 by any suitable means, such as use of adhesives, longitudinally-mounted rails, and the like. In such alternate constructions, the boundaries of front and rear mounting zones 24 and 28 would simply correspond generally to the outline of the portions of the front and rear bindings which are adjacent to top surface 20 of body 16.

FIGS. 2–5 show alternative cross-sections of a conventional snowboard 10. Each cross-section is taken along line A—A of FIG. 1 which traverses rear mounting zone 28. However, the conventional cross-sections shown in FIGS. 2–5 are representative of a transverse cross-section taken at any point along snowboard 10. The various elements shown in FIGS. 2–5 all exist in the prior art and are customarily used in the construction of conventional snowboards.

In the construction shown in FIG. 2, body 16 broadly comprises a central core 38 surrounded by a cover (unnumbered). The cover is conventionally of substantially uniform thickness all along the length of the snowboard. Two major components of the cover for core 38 are a base 32 and a cap 40. Base 32 is the major portion of snowboard 10 which comes in contact with the snow. Base 32 is preferably made of an ultra high molecular weight (UHMW) polyethylene, either extruded or sintered, chosen for its durability and the ease with which it glides over the surface of the snow. Flanking base 32 and bonded thereto are a pair of edges 34, preferably made of a high grade steel. Edges 34 cut into the snow when snowboard 10 is carving its turns. Bottom surface 18 of body 16 therefore comprises the flush bottom surfaces of base 32 and edges 34.

A lower structural layer 36, extending from side to side of snowboard 10, is preferably bonded in an epoxy adhesive to base 32 and edges 34. The predominant material for structural layer 36 is fiberglass cloth, although there is some use of hemp cloth, other textile materials, and even wood veneer. Fiberglass cloth is preferred and is laid up in either a triaxial, biaxial, or uniaxial direction, depending on the design required.

Structural layer 36 is also preferably bonded in an epoxy adhesive to central core 38. Snowboard cores can be formed from one or more of a wide number of different materials, however, laminated wood, foam, and fiberglass are the most commonly used. Laminated wood is preferred, but foam, wood and foam, and laminates of fiberglass cloth (not shown) are known.

In FIG. 2, core 38 is shown as composed of laminated wood wherein thin strips of wood 50 are laminated in a vertical orientation. Horizontal lamination is also employed but is somewhat less common. Laminated wood is preferred to using a single, solid piece of wood for two reasons. First, using a single piece of wood would require a much larger and therefore more expensive piece of wood. More importantly, large pieces of solid wood which do not contain defects, such as knots, are difficult if not impossible to obtain. Laminated wood provides more uniform strength and flexibility.

Cap 40 comprises an upper structural layer 42 and a top sheet 44. Cap 40 is normally bonded in an epoxy adhesive to core 38. Like lower structural layer 36, upper structural layer 42 is usually made of fiberglass cloth, although hemp cloth, other cloths, and wood veneer are also known. Top sheet 44 is typically a polyester sheet which functions as a canvas on which the snowboard's graphics are displayed. Cap 40 is smoothly adhered to core 38 with outwardly extending extremities 46 of upper layer 42 being bonded to edges 48 of lower layer 36 to form the cover which seals central core 38 and provides aesthetic protection for body 16.

In FIG. 3, core 38 is made of foam 52. Core 38 can be manufactured as a solid, prefabricated foam block, or it can be the result of injecting a foaming material into a pocket formed by top layer 42 and lower layer 36. Foam is typically less expensive and more durable than wood, but usually is slightly heavier and more damp.

FIG. 4 shows a combination of wooden strips 50 formed over a centrally located layer of foam 51 to form core 38.

FIG. 5 shows a core 38 formed of wood, as in FIG. 2, the difference being that in FIG. 6 core 38 is encased within a sheath of fiberglass cloth 52. Although sheath 52 could be used in combination with any of the core constructions shown in FIGS. 2–4, it is most commonly used with a wood core.

As explained above, skis and snowboards are very structurally similar, As will be described in greater detail herein, the method of the present invention is equally applicable to skis. Therefore, a brief explanation of the general structure of a ski is also believed to be helpful.

Referring to FIG. 24, there is illustrated a side view of a ski 310 located in a snow surface 5. As is conventional, ski 310 includes a nose 312, a tail 314, and a body 316 which extends between nose 312 and tail 314. Body 316 generally includes a top surface 320, a bottom surface 318, and a mounting zone 324 located on top surface 320. FIGS. 2–5 are representative of several embodiments of a cross-section of ski 310 taken anywhere along body 316.

OBJECTS AND SUMMARY OF THE INVENTION

It is therefore a primary object of this invention to provide a method of making a snowboard or a ski that has greatly improved turning characteristics by taking into account the dynamic flexibility of the snowboard or ski along its length when downward loading increases beyond the point at which the riding edge of the snowboard or ski fully contacts the snow.

Another object of the present invention is to provide a snowboard, and a method of making same, in which the front and rear portions of the snowboard follow a single track during turns.

It is another object of the present invention to provide a snowboard that minimizes friction or drag on the snowboard as it moves through the snow, particularly during turns.

It is another object of the present invention to provide a snowboard that is easier for the rider to control during turns, especially tight, sharp turns.

The foregoing and other objects are attained in accordance with one aspect of the present invention by providing a method of making a snowboard which includes the steps of selecting a desired longitudinal curvature of the snowboard during turns, determining the desired flexibility of the snowboard at a plurality of cross-sectional portions thereof in order to achieve the desired curvature, and selecting the cross-sectional dimensions of each of the plurality of cross-sections to provide the desired flexibility.

More particularly, determining the desired flexibility of the core comprises the step of determining the desired area moments of inertia at each cross-section which, in turn, may include the step of calculating the bending moments at each cross-section. The calculation of the bending moments will require the weight and skill of the intended user of the snowboard or ski to be determined.

Calculating the bending moments at each of the plurality of cross-sectional portions also preferably includes the steps of determining the downward force exerted upon the snowboard or ski by the weight of the intended user at the plurality of cross-sectional portions, and assuming a uniform upward force exerted upon the effective length of the snowboard or ski by the surface of the snow.

In accordance with the objects of the present invention, the optimum curvature of the bottom surface of the snowboard during turns is a circular arc, however, other similar curvatures, such as parabolic, hyperbolic or elliptical arcs will produce substantial improvements in turning performance over the snowboards of the prior art.

The present invention produces a snowboard which exhibits superior control and "feel" over snowboards of the prior art and substantially reduces plowing in turns, particularly tight, sharp turns. The method of the present invention may also be applied to skis.

In accordance with another aspect of the present invention, there is provided a snowboard that comprises a nose, a tail and a body formed between the nose and the tail. The body includes a bottom surface, a core, and a cover surrounding the core. Front and rear mounting zones are located on the body, and a center section extends between the mounting zones. The average cross-sectional area of the core in the center section is preferably less than the average cross-sectional area of the core in at least one of the front and rear mounting zones.

In accordance with another aspect of the present invention, the center section average cross-sectional area may be less than that in both of the mounting zones. Further, the bottom surface of the body of the snowboard is preferably capable of bowing into substantially circular arcs under ideal loading conditions. Also, the thickness of the core varies gradually between and including the mounting zones and center section. Further, the core preferably comprises a substantially homogeneous material from one mounting zone to the other.

In accordance with another aspect of the present invention, the average cross-sectional area moment of inertia of the core in the center section is preferably less than the average cross-sectional area moment of inertia of the core in at least one of the front and rear mounting zones.

In accordance with yet another aspect of the present invention, the average cross-sectional thickness of the core in the center section is preferably less than the average cross-sectional thickness of the core in at least one of the front and rear mounting zones. More particularly, in symmetrical snowboards, the average cross-sectional thickness of the core in the center section is less than that in both of the mounting zones, while in an asymmetrical snowboard, the average cross-sectional thickness of the core in the center section is less than that in only the front mounting zone.

BRIEF DESCRIPTION OF THE DRAWINGS

The foregoing and other objects, aspects, uses, and advantages of the present invention will be more fully appreciated as the same becomes better understood from the following detailed description of the present invention when viewed in conjunction with the accompanying drawings, in which.

DETAILED DESCRIPTION OF THE PRESENT INVENTION

Figure 1:
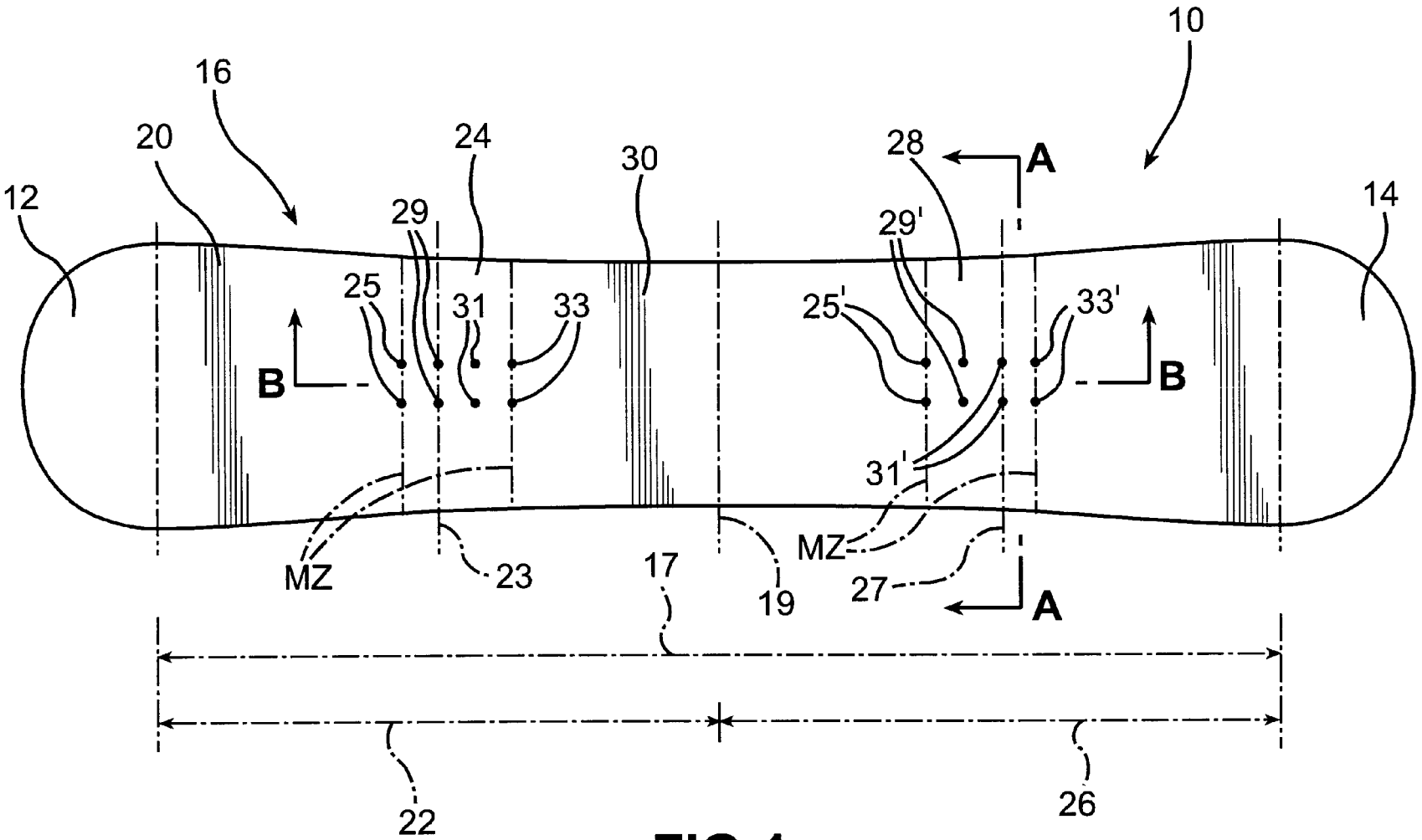
FIG. 1 is a top view of a conventional snowboard.

The broad goal of the present invention is to make a snowboard or ski that is capable of bowing into a desired curvature during turns. The present invention thus differs from conventional snowboard and ski design in that the present invention. takes into account the shape that the board or ski bends into during a turn. While the majority of the following detailed description of the present invention will be set forth with respect to snowboard design, it will be understood by a person of ordinary skill in the art that many of the principles of the method of the present invention may also be beneficially applied to the design of skis, as will be discussed briefly below in §B.

Thus, as opposed to conventional snowboard design, I have discovered that not only does it matter to take into account the fact that the board continues to bend after the riding edge makes full contact with the snow during a turn, but that the particular shape of the bend matters. Accordingly, with the present invention, one can select a particular shape into which one desires the snowboard to bend during a turn, thereby enabling maximum performance to be achieved.

More particularly, in one preferred embodiment, I have discovered that in order to form sharp, tight turns, and thus minimize plowing, the snowboard should be designed so as to be capable of bowing into substantially circular arcs during turns. A rider can tell when this "circular arc" condition occurs (or is approached) when the rear portion of the snowboard substantially follows in the track of the front portion when carving a turn.

The goal of designing a snowboard which is capable of bending into a desired shape is achieved in accordance with the present invention by focusing on the relative flexural stiffness of a plurality of cross-sectional portions of the snowboard along its effective length. This, in turn, is accomplished by selecting the physical characteristics of each cross-sectional portion of the board so that the snowboard is capable of bowing into the desired shape during turns. The area moment of intertia of each cross-sectional portion is the preferred cross-sectional physical characteristic to be varied, as will be explained in greater detail below in §§ A and B that describe the preferred method of making a snowboard in accordance with the present invention.

Preferred embodiments of snowboards of the present invention that may result from application of the inventive method are described in detail below in §§ C, D and E.

Therefore, in order to facilitate understanding of the present invention, this detailed description has been divided into six sections, as follows:

A. Theorectical Principles

B. Preferred Method of the Present Invention

C. Preferred Embodiments of Symmetrical Snowboard

D. Preferred Embodiment of Asymmetrical Snowboard

E. Alternate Cross-Sectional Core Constructions

F. Conclusion

It should also be understood that those portions of the foregoing description of "GENERAL SNOWBOARD STRUCTURE" in the BACKGROUND OF THE INVENTION portion of the specification that are not inconsistent with the present invention are certainly within the purview of the preferred snowboard embodiments to be set forth below. In other words, the present invention may well be applied to the general snowboard structure as set forth above.

A. Theoretical Principles

As stated above, the broad goal of the present invention is to design a snowboard that is capable of bowing into a desired curvature during turns. This goal is accomplished by initially treating the snowboard as a beam and applying principles of beam mechanics to determine the physical characteristics of the snowboard which will result in the desired curvature.

The expected curvature of a beam at a particular transverse cross-section along its length can be approximated by the following equation:

$$C=1/\rho=M/(EI) \quad (1)$$

where

C=the curvature of the beam

ρ=the radius of curvature of the beam

M=the bending moment of the beam

E=the modulus of elasticity of the beam, and

I=the area moment of inertia of the beam.

See Beer, Ferdinand Pierre: MECHANICS OF MATERIALS, Von Hoffman Press, Inc., 1981, pp. 153–159, 438–447, and 579–583, incorporated herein by reference, for a detailed discussion of these concepts.

Figure 2:
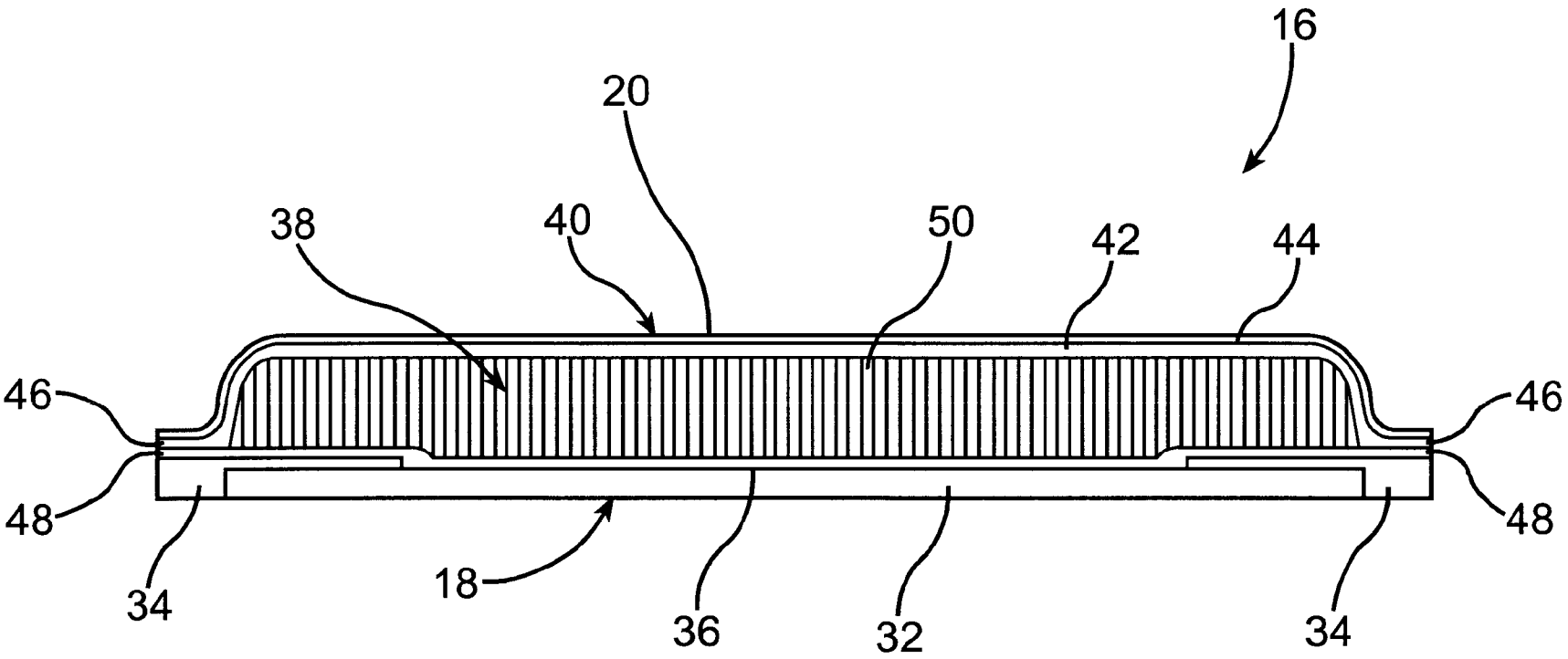
FIG. 2 is a cross-sectional view of one possible core construction that is both conventional and may be used with the present invention.
Figure 3:
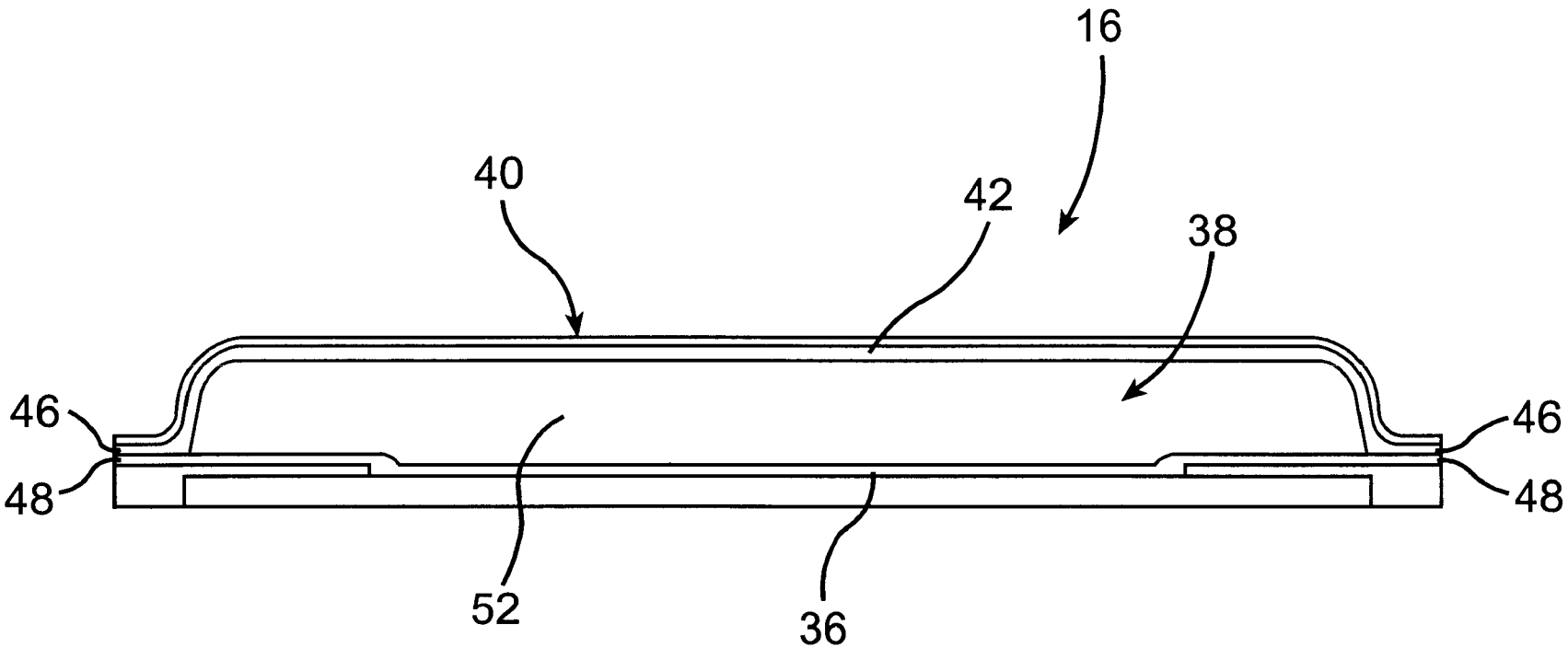
FIG. 3 is a cross-sectional view of an alternative core construction.

In accordance with the present invention, and with reference when necessary to FIGS. 1 & 2, snowboard 10 is treated as a beam. As noted above, in order to minimize plowing, the snowboard should be designed so that its bottom surface bows into substantially circular, longitudinal arcs during turns. Thus, if the desired curvature C is circular, then the longitudinal curvature C is constant along the entire effective length 17 because a circular arc has a constant radius of curvature ρ. If the desired curvature C of the bottom surface 18 is another shape, such as parabolic, hyperbolic, or elliptical, curvature C would vary along the effective length 17.

It should be noted that as a practical matter, the effective length of a snowboard is very small relative to the radii of curvature of the arcs in which the snowboard can be expected to bend during use. A small portion of a parabolic arc having a relatively large radius of curvature approximates a circular arc. Thus, a parabolic arc and a circular arc are equivalent shapes for the purpose of selecting a desired curvature for the bottom surface of a snowboard.

As is apparent from equation (1), the longitudinal curvature C of a snowboard is directly proportional to the bending moment M, and inversely proportional to the modulus of elasticity E and area moment of inertia I. As a practical matter, I have discovered that achieving the desired curvature C may be approximated by selecting a plurality of transverse cross-sections of the snowboard, taken at small increments (for example, every 5 millimeters) along the entire effective length, and then selecting the appropriate cross-sectional dimensions of snowboard 10 at each selected cross-section in order to achieve the desired curvature C at that cross-section. In other words, the curvature C at each transverse cross-section will be dependent upon the bending moment M, modulus of elasticity E and moment of inertia I at that cross-section. The resultant overall curvature C of the snowboard will be the composite of the individual cross-sectional curvatures.

In theory, any one of the three components (bending moment M, modulus of elasticity E and moment of inertia I) could be chosen as the design variable to achieve the desired longitudinal curvature C along the entire effective length 17 of snowboard 10. However, I have determined that bending moment M at each cross-section is primarily dependent upon the relative location of front and rear mounting zones 24 and 28, the weight of the rider for which snowboard 10 is designed, and the distribution of the rider's weight during turns. None of these variables can be manipulated in a manner that achieves the desired longitudinal curvature C without otherwise detrimentally affecting the performance of snowboard 10 and/or requiring the rider to contort himself or herself into awkward positions while piloting the snowboard. Thus, bending moment M is not the preferred design variable.

Similarly, varying the modulus of elasticity E of the snowboard's materials along the length of the snowboard has proven prohibitively expensive, as well as extremely difficult to manufacture.

This leaves the area moment of inertia I as the operative design variable to achieve the desired longitudinal curvature C at any transverse cross-section along the effective length of the snowboard.

The formula for calculating the area moment of inertia at a particular cross-section is given in equation (2):

$$I=\int\int y^2 da \quad (2)$$

where

I=area moment of inertia of the cross-section, da=the differential area of the cross-section, and y=distance to the differential area from the axis of rotation of the cross-section.

See Beer, supra, page 157. Since it is the longitudinal flexibility of snowboard 10 which is the focus of the present invention, the axis of rotation is an axis drawn transversely through the center of geometry of the cross-section. From the mathematical definition (2), it can be seen that, significantly, the area moment of inertia I depends only on the geometry of the cross section, i.e., its cross-sectional shape.

Equation (2) has been applied to common two-dimensional shapes, e.g., rectangles, triangles, circles, semi-circles, etc., with known results (such shapes can be considered to be potential cross-sectional shapes of the snowboard):

$$\text{Rectangle: } I=bh^3/12 \quad (3)$$

$$\text{Triangle: } I=bh^3/36 \quad (4)$$

$$\text{Circle: } I=\pi r^4/4 \quad (5)$$

$$\text{Semi-circle: } I=\pi r^4/8 \quad (6)$$

where

I=the area moment of inertia of the cross-sectional shape, b=width of the base of the cross-sectional shape, h=the height of the cross-sectional shape, and r=the radius of the circle and/or semi-circle.

The area moment of inertia I of complex shapes can be determined by subdividing the complex shapes into parts having simpler shapes and by summing the area moments of inertia of the parts. See Beer, supra, pp. 443–447.

As equations (2)–(6) demonstrate, the moment of inertia I may be varied at each cross-section along the entire effective length of the snowboard by simply varying the snowboard's cross-sectional dimensions. The width of the snowboard at each cross-section is largely determined by other performance considerations. In addition, the area moment of inertia I is much more sensitive to the height (thickness) of the cross-sectional shape than it is to the width of that shape. Therefore, larger variations in area moment of inertia I can be affected with smaller changes in thickness than in width. It may be appreciated, therefore, that in accordance with the present invention the thickness of the snowboard at each selected cross-section is the preferred design variable.

The thickness of any component of the snowboard could be varied to achieve the optimum area moment of inertia at each cross-section along effective length 17 of snowboard 10. However, in the preferred embodiment of the present invention, the thickness of the core 38 is chosen as the design variable, primarily because varying the thickness of core 38 greatly simplifies manufacture and minimizes costs.

B. Preferred Method of the Present Invention

In accordance with equations (2)–(6) and as noted above, in accordance with the present invention the moment of inertia I is varied at each cross-section along the entire effective length of the snowboard by varying the snowboard's cross-sectional dimensions. The thickness of the core of the snowboard at each cross-section is the preferred design variable, as will be explained in greater detail below. In accordance with the preferred embodiment of the present invention, the thickness of the core at each cross-section is selected to yield an overall longitudinal curvature for the board that is substantially constant, i.e., a circle.

The preferred method of the present invention of calculating the desired area moment of inertia $I_d$ at any longitudinal point on the snowboard (hereinafter called the "selected cross-section") begins with determining the weight and snowboarding style of the rider that the snowboard is being designed for. The rider's snowboarding style will determine a maximum desired curvature $C_m$ of the snowboard. A snowboard designed for a more aggressive rider will have a larger maximum curvature $C_m$ than a snowboard designed for a less aggressive rider.

Next, the horizontal planar dimensions of the snowboard, i.e., length, width and side cut depth, are chosen. Generally, a larger maximum curvature $C_m$ results in a shallower side cut. As will be described in greater detail herein, the planar dimensions of the snowboard may be symmetrical (i.e., where the rear portion of the snowboard is a mirror image of the front portion), or asymmetrical, depending upon the intended use of the snowboard. Once these characteristics are chosen, the position of the front and rear mounting zones 24 and 28 (and thus, the location of the downward loads applied by the rider's feet) on the snowboard are determined. On a symmetrical snowboard (a snowboard in which front and rear portions 22 and 26 are mirror images of one another), front and rear mounting zones 24 and 28 are often equidistant from the midpoint 19 of effective length 17. In contrast, front and rear mounting zones 24 and 28 are often offset rearwardly in an asymmetrical snowboard.

Next, the bending moment M at the selected cross-section on snowboard 10 can be calculated given the weight of the rider. The assumed distribution of the downward force applied by the rider through front and rear mounting zones 24 and 28 during a turn will depend upon the type of snowboard being designed. For example, more than half of the rider's weight may be assumed to be on the front mounting zone 24 for a "freeride" snowboard (i.e., a snowboard designed to be used on traditional ski slopes at moderate speeds) or for a "freecarve" snowboard (i.e., a snowboard designed to be stable at high speeds). This assumption accounts for the snowboarder's tendency to lean downhill while riding. Alternatively, the rider's weight may be assumed to be equally distributed between front and rear mounting zones 24 and 28 for a "freestyle" snowboard (i.e., a snowboard designed for use in a half-pipe ski slope). This is because the rider of a freestyle snowboard will frequently reverse directions (i.e., riding alternately nose-first and tail-first).

Regardless of the assumed distribution of downward loading, the inventive method of the present invention assumes that the snow imposes a uniform upward force on the snowboard equal and opposite in direction to the total downward force applied by the rider. This assumption is one of many significant departures of the present inventive method from conventional snowboard design in which a snowboard is constructed to perform as if it were supported solely at two points during use (including during turns), one at each end of the effective length of the snowboard.

The above-described loading conditions, including: (1) the placement and distribution of the rider's weight for which the snowboard is designed; and (2) a uniform upward force exerted on the snowboard by the snow surface in an equal and opposite direction to the total downward force applied by the rider, are referred to herein as the "ideal loading conditions" for a particular snowboard. In addition, the magnitude of the downward force required to provide "ideal loading conditions" must be greater than the downward force sufficient to cause the riding edge of the snowboard to be in full contact with the snow.

Once the bending moment M and maximum curvature $C_m$ of the snowboard are determined, the core material of the snowboard, which has a fixed modulus of elasticity E, is selected. As explained above, laminated wood is the most common material. Then, equation (1) is used to determine the desired area moment of inertia $I_d$ for the selected cross-section of the snowboard.

In order for the selected cross-section of the snowboard to flex into the desired curvature under ideal loading conditions, the actual area moment of inertia $I_a$ of the selected cross-section must be equal to the desired area moment of inertia $I_d$ for that cross-section, as calculated above. However, as FIGS. 2–5 illustrate, each cross-section of the snowboard is composed of a number of components of various shapes. The preferred method for determining the actual area moment of inertia $I_a$ of the selected cross-section is to create a composite actual area moment of inertia $I_a$ equal to the sum of the area moments of inertia of each of the components of the selected cross-section.

As stated above, the thickness of the core is the preferred design variable to achieve the desired area moment of inertia $I_d$ at the selected cross-section. Thus, the next step in the inventive technique is to select the components used to construct the snowboard, leaving the thickness of the core as the only variable. This includes determining the position (relative to the other components), materials and dimensions of all of the components of the snowboard, e.g., the cap, sidewalls, edges and base.

The contribution of each component of the selected cross-section to the composite actual area moment of inertia $I_a$ is a function of the thickness of the core. For example, as the thickness of the core increases, the distance between the base and the axis of rotation increases, and therefore, the area moment of inertia of the base about the axis of rotation also increases. Thus, the next step in the inventive technique is to create an expression for the actual composite area moment of inertia $I_a$ for the selected cross-section. Each term of the expression is equal to the area moment of inertia I of each component of the selected cross-section expressed as a function of the thickness of the core.

In order for the actual moment of inertia $I_a$ to equal the desired moment of inertia $I_d$, the value of the expression for the actual composite area moment of inertia $I_a$ for the selected cross-section must equal the desired area moment of inertia $I_d$. Thus, the expression must be solved for the thickness of the core. Unfortunately, the expression for the actual composite area moment of inertia $I_a$ is typically a $4^{th}$ order polynomial and is not easily solvable. Thus, in accordance with the present invention, a value for the appropriate core thickness is "guessed". Then, the actual composite area moment of inertia $I_a$ is compared to the desired area moment of inertia $I_d$. If the actual composite area moment of inertia $I_a$ is larger than the desired area moment of inertia $I_d$, the process is repeated using a smaller value for the core thickness. Conversely, if the actual composite area moment of inertia $I_a$ is smaller than the desired area moment of inertia $I_d$ the process is repeated using a larger value for the core thickness. This process is repeated until the actual composite area moment of inertia $I_a$ equals the desired area moment of inertia $I_d$. This iterative process is preferably expedited by the use of a programmable digital computer.

The above-described method is repeated for each incremental cross-section along the entire length of snowboard 10.

It must be emphasized that the bottom surface of a snowboard designed in accordance with the above-described design principles is capable of bowing into the desired curvature under ideal loading conditions. This does not mean that the bottom surface will always bow into the desired curvature when in use. As is wellknown in the art, the loads exerted on a snowboard during use are dynamic, both in terms of magnitude and distribution. The magnitude and distribution of the downward forces imposed on the snowboard by the rider vary widely as the rider shifts his or her weight to initiate turns, go over uneven terrain, etc. In addition, the upward force imposed on the snowboard by the snow surface will rarely (if ever) be perfectly uniform because snow is rarely perfectly uniform under real-world conditions.

As a practical matter, therefore, it is not possible to design a snowboard such that its bottom surface will bow into the desired curvature under all of the loading conditions which will occur while the snowboard is in use. However, by designing snowboard 10 such that under ideal loading conditions its bottom surface 18 will bow into the desired curvature, then under real-world conditions the bottom surface 18 of snowboard 10 will bow into shapes much more closely approximating that curvature than the snowboards of the prior art.

As stated above, the design goal in one embodiment of the present invention is a snowboard capable of bowing into a circular arc under the magnitude and distribution of loads for which the snowboard is designed. Since a snowboard is subjected to dynamic loads during use, a properly designed snowboard in accordance with this embodiment will be capable of bowing into many circular arcs under loads of varying magnitude, so long as the distribution of such loads corresponds to the distribution for which the snowboard was designed.

Although the above-described method was originally conceived to improve the performance of snowboards, the method may also be beneficially applied to skis. Designing a ski in accordance with the above-described method would be very similar to designing a snowboard. Of course such application must take into account the fact that only one of the rider's boots is positioned on each ski. In addition, the boot is longitudinally oriented on the ski. In this case, the front and rear portions of a ski binding constitute the downward loads applied by the rider onto the ski. In addition, it would be assumed that only a portion of the rider's total weight (e.g., half or two-thirds) would be applied onto each ski during turns.

C. Preferred Embodiments of Symmetrical Snowboard

Figure 6:
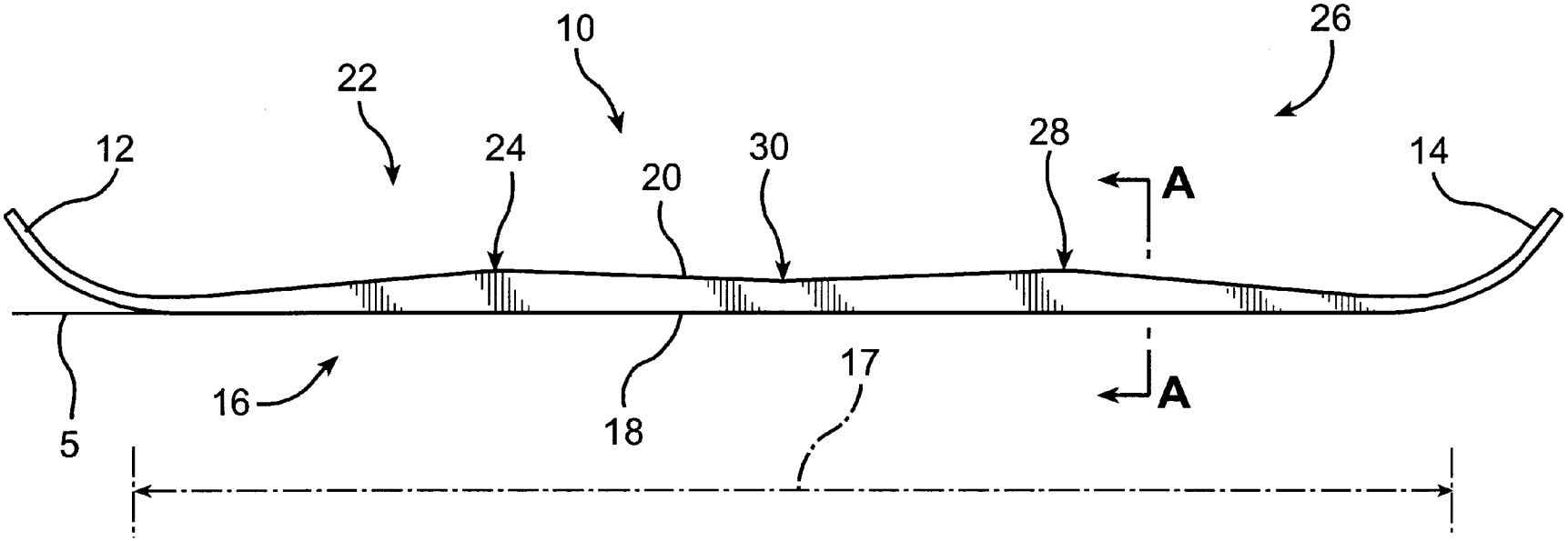
FIG. 6 is side view of a first preferred embodiment of the present invention.

Referring now to FIG. 6, there is illustrated a side view of one preferred embodiment of a snowboard according to the present invention that results from the present inventive technique discussed above. In FIG. 6, like reference numerals used previously to describe certain components of conventional snowboards are also used herein, with the understanding that the snowboard of the present invention is anything but conventional.

Snowboard 10 is representative of a "freestyle" snowboard, a snowboard designed for use in a half-pipe. Snowboard 10 is preferably symmetrical to allow the rider to easily pilot the snowboard in either direction (i.e., with either the nose or tail leading).

Snowboard 10 in FIG. 6 includes body 16 from the forward and rear extremities of which extend nose 12 and tail 14. Effective length 17 is also represented in FIG. 6, as is bottom surface 18, top surface 20, front portion 22, rear portion 26, front mounting zone 24, rear mounting zone 28, and central section 30. FIG. 6 depicts snowboard 10 in an "unloaded" state, i.e., without being loaded by the weight of a rider. Under these conditions, the shape of bottom surface 18 in this embodiment is generally flat along effective length 17.

Snowboard 10 is designed, in accordance with the above-described method, so that bottom surface 18 is capable of bowing into a circular arc under ideal loading conditions. As stated above, the method of the present invention may be employed to design a snowboard to bow into many different desired shapes under ideal loading conditions, however, a circular arc is the preferred shape of bottom surface 18 because this shape minimizes plowing and causes the front portion 22 to follow rear portion 26 during turns.

Figure 7:
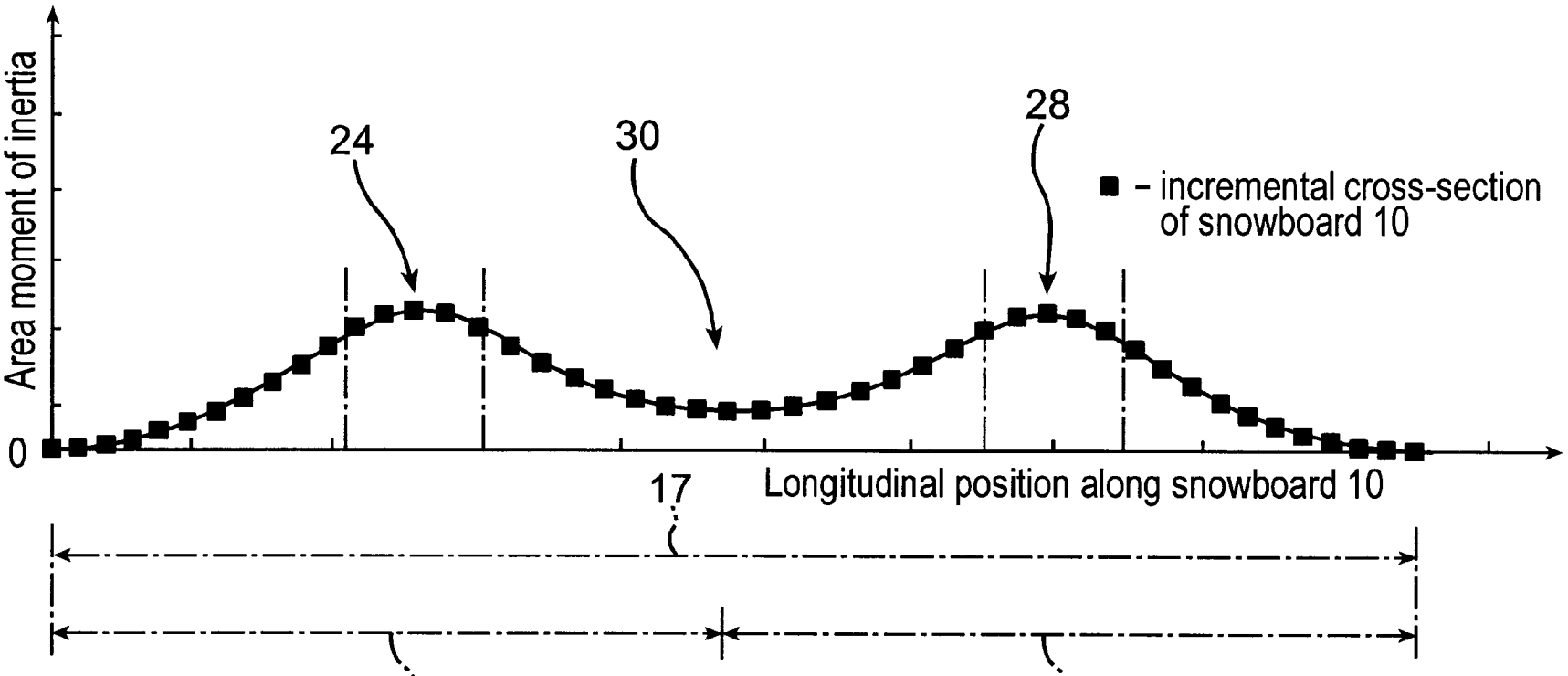
FIG. 7 is a graph showing relative area moments of inertia of a set of incremental cross-sections of the preferred embodiment of FIG. 6.

FIG. 7 is a graph showing a typical plot of relative area moments of inertia for a set of incremental cross-sections of snowboard 10 of FIG. 6 determined in accordance with the above-described method. Area moments of inertia are plotted on the vertical axis and on the horizontal axis is the location of each incremental cross-section along effective length 17 of body 16 where the corresponding area moment of inertia is determined. Note that in the front and rear mounting zones 24 and 28, the area moments of inertia are greater than those in center section 30. In other words, using the method of the present invention to select the thickness of core 38 at incremental cross-sections results in an average area moment of inertia of the entire cross-section of snowboard 10 within front and rear mounting zones 24 and 28 which is greater than the average area moment of inertia within center section 30.

It must be emphasized that the graph shown in FIG. 7 represents the area moments of inertia for the transverse cross-sections of snowboard 10, including core 38 and all cover components, because it is the total area moment of inertia at each cross-section that determines the flexibility of snowboard 10 at that cross-section. However, since the cover elements are preferably substantially uniform in thickness, the area moment of inertia for core 38 at a cross-section is roughly proportional to the total area moment of inertia snowboard 10 at that same cross-section.

Figure 8:
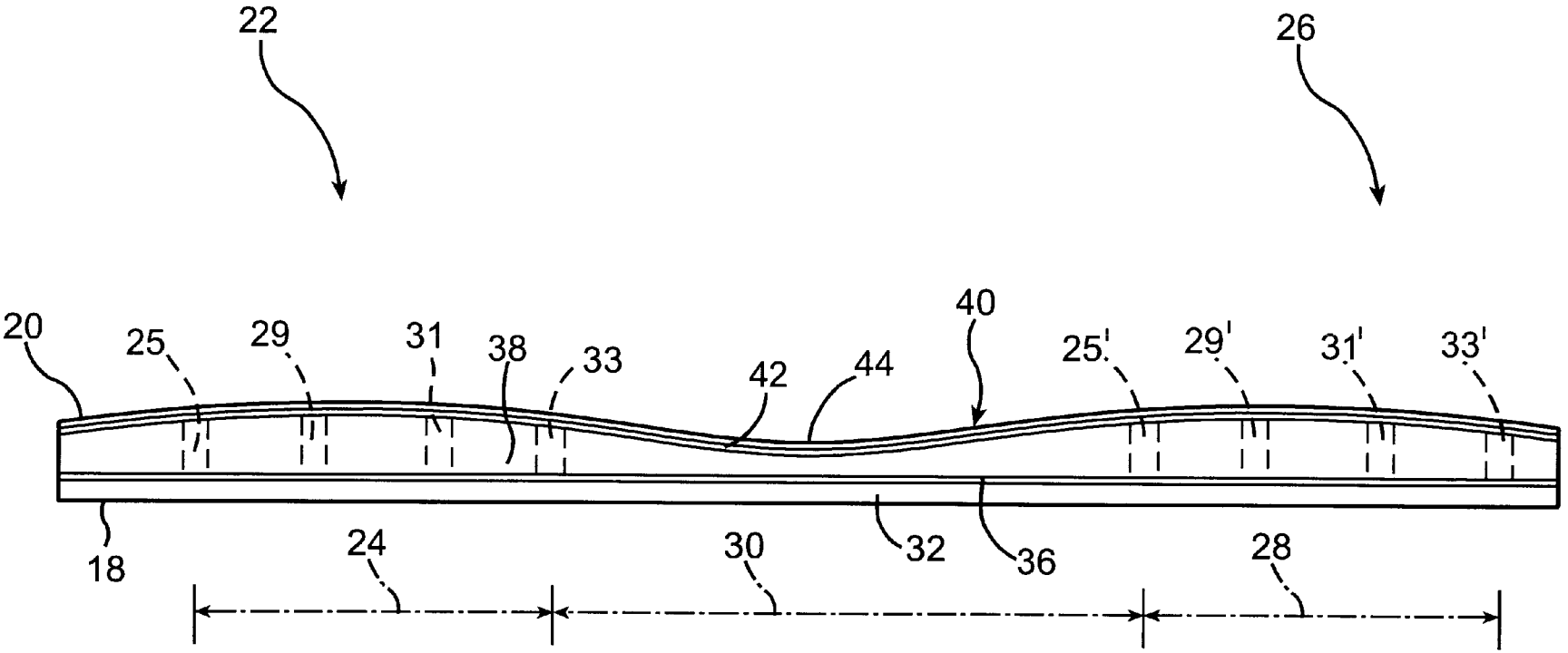
FIG. 8 is an enlarged longitudinal sectional view showing the first embodiment of the present invention as if taken along line 8—8 of FIG. 1.

Referring now to FIG. 8, there is illustrated a partial longitudinal sectional view of the preferred embodiment shown in FIG. 6 of the present invention in an unloaded state. This partial sectional view can be thought of as taken along line 8—8 of FIG. 1. Application of the method of the present invention results in a core 38 that has an average cross-sectional thickness which is greater within front and rear mounting zones 24 and 28 than in center section 30. The average cross sectional thickness of core 38 within front and rear mounting zones 24 and 28 is also greater than that in nose 12 and tail 14. The average cross-sectional thickness of core 38 along a portion of body 16 can be calculated by summing the thicknessess of core 38 at a sampling of cross-sections of snowboard 10 within the portion in question (taken at 5 millimeter increments, for example) and dividing that sum by the number of incremental cross-sections sampled. The exact thicknessess of core 38 near nose 12, front mounting zone 24, center section 30, rear mounting zone 28 and tail 14 may change from snowboard to snowboard, but they are characterized by the relative thicknessess as defined above. It should also be understood that the drawings do not show exact proportions for thicknesses, but rather are exaggerated for clarity. Also, since the thickness of the core varies along its length, the core's cover (consisting of elements 32, 36, 42 and 44) are preferably of substantially uniform thickness along the length of the snowboard.

Design of a symmetrical snowboard, such as snowboard 10, according to the present invention results in a core profile which is markedly different from snowboards of the prior art. The most visible difference between snowboard 10 and prior art snowboards is that core 38 of the present invention is relatively thin in center section 30, as opposed to conventional snowboards whose center section is the thickest part of the snowboard. Making center section 30 thinner permits snowboard 10 to bend more readily under normal loading, thereby making it easier to control. Also, center section 30 is thin enough that, when the snowboarder shifts his/her weight in a normal manner so as to direct a turn, snowboard 10 will respond by assuming a substantially circular arc of a radius commensurate with the weight shifts. Under those conditions, snowboard 10 will make an ideal turn. That is, snowboard 10 will carve a turn in the snow in which rear portion 26 substantially follows in the track of front portion 22.

As shown in FIG. 8, the variation in the thickness of core 38 at each cross-section along effective length 17 is preferably gradual or smooth between the front border 25 of front mounting zone 24 and rear border 33' of rear mounting zone 28. As used herein, a "gradual" or "smooth" variation in the thickness of core 38 means that the thickness of core 38 gently increases and decreases along the portion of snowboard 10 in which the gradual or smooth thickness change is deemed to occur, i.e., there are no abrupt changes (stepped increases or decreases) in the thickness of core 38 along the portion of snowboard 10 which has a gradual or smooth variation in its thickness. Discontinuities and stepped changes in thickness of core 38 are undesirable because such "non-gradual" variations result in stress concentrations, thereby increasing the likelihood of structural failure.

Figure 4:
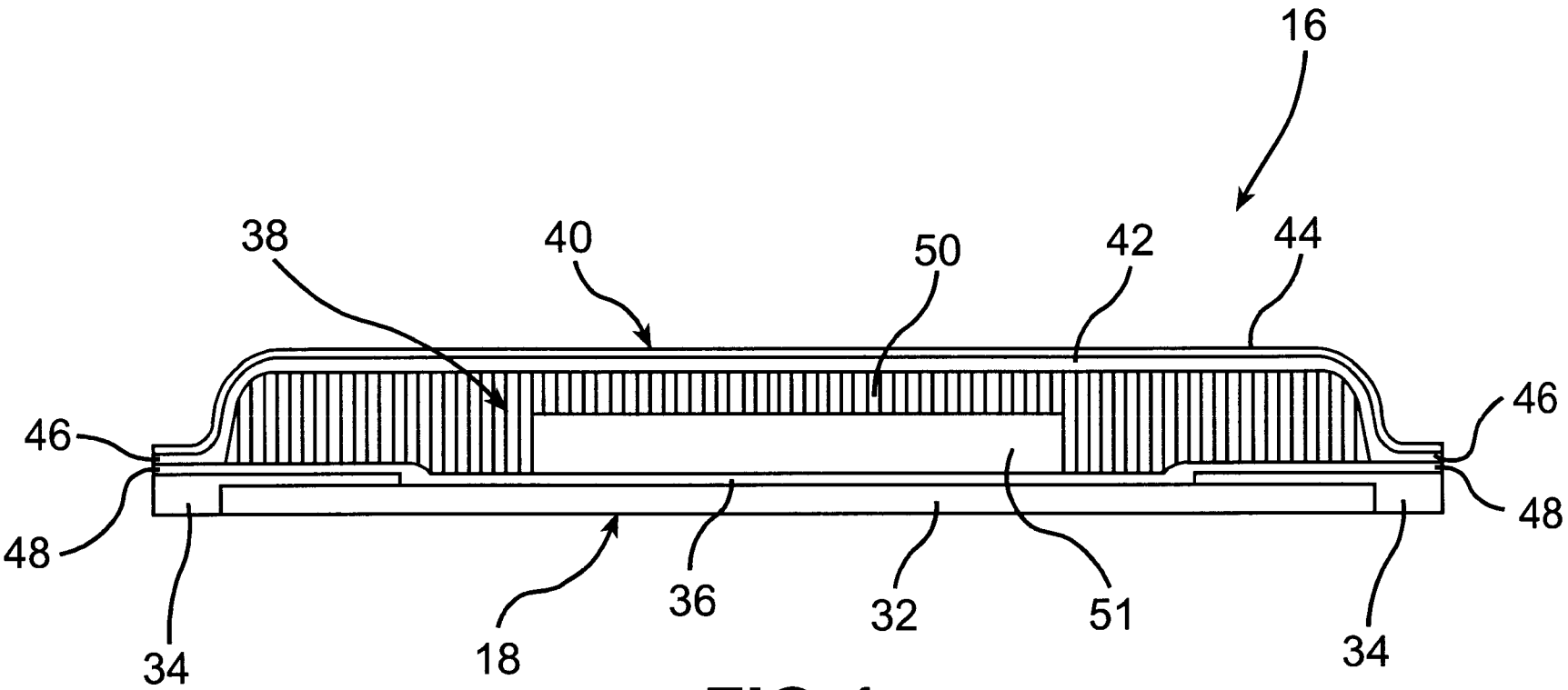
FIG. 4 is a cross-sectional view of another alternative core construction.
Figure 5:
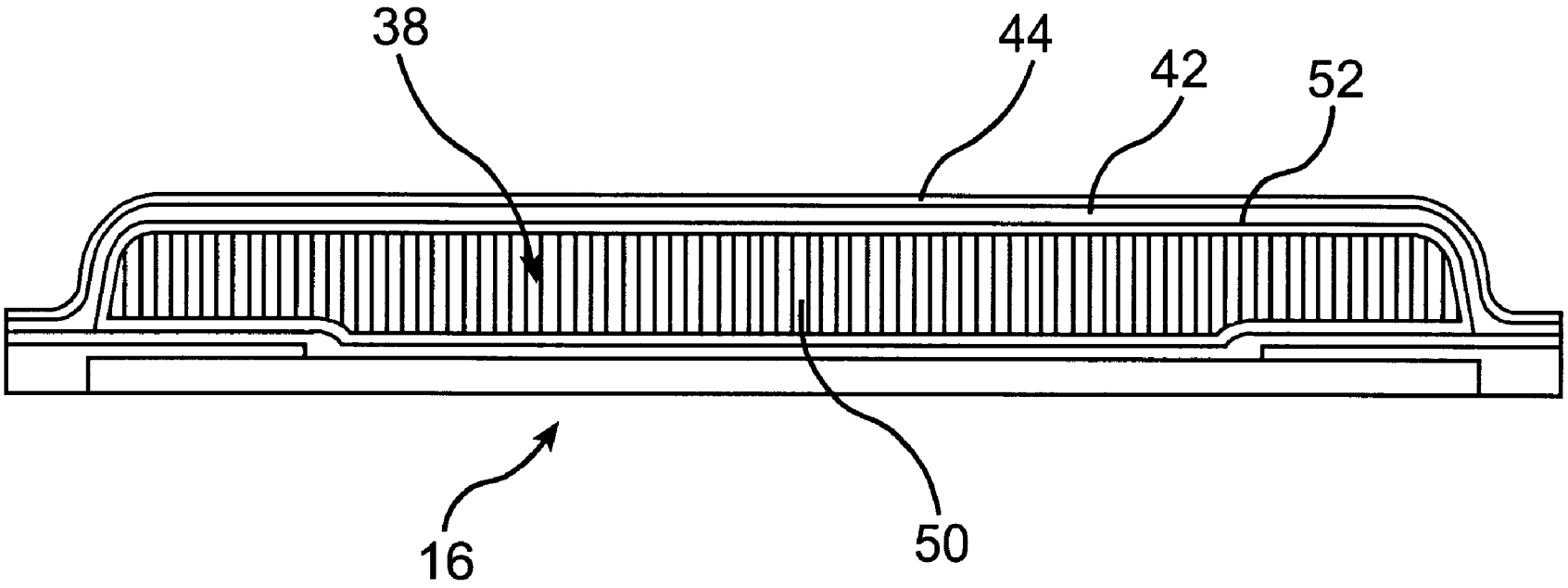
FIG. 5 is a cross-sectional view of another alternative core construction.

As also shown in FIG. 8, core 38 is preferably homogeneous from the front border 25 of front mounting zone 24 to the rear border 33' of rear mounting zone 28. The term "homogeneous", when used herein, means that the composition of core 38 (typically laminated wood, foam, or a combination of wood and foam) is substantially the same at any given cross section along the length of snowboard 10. For example, if core 38 is formed of a single material, such as wood or foam (as shown respectively in FIGS. 2 and 3), core 38 is "homogeneous" in that core 38 consists solely of that material. On the other hand, if core 38 is formed of a combination of materials, such as laminated wood and foam (as shown in FIG. 4), core 38 is "homogeneous" in that core 38 consists solely of that combination of materials and the relative proportions of each material forming core 38 are approximately the same at any given cross section along the length of snowboard 10.

Figure 9:
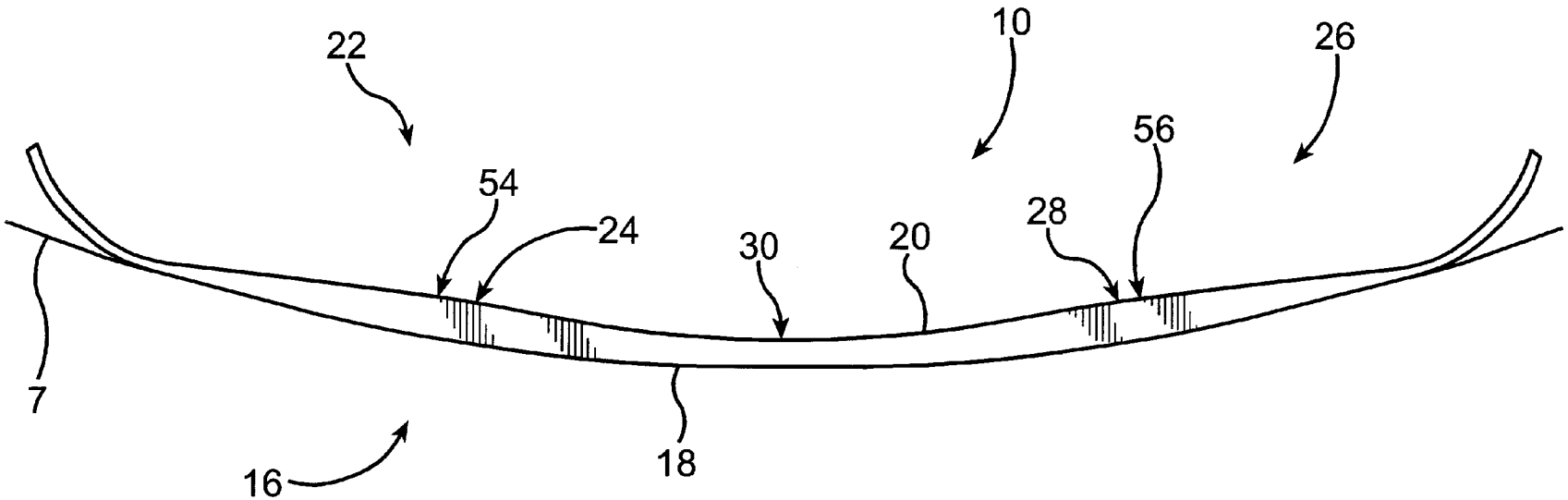
FIG. 9 is a side view of the preferred embodiment shown in FIG. 6 when under ideal loading conditions.

Referring now to FIG. 9, snowboard 10 of FIGS. 1, 6 and 8 is shown under ideal loading conditions. The weight of the rider is applied to snowboard 10 in two separated locations, indicated by arrows 54 and 56, in mounting zones 24 and 28, respectively, and snowboard 10 is seen to be bowed into a substantially circular arc 7. In this manner, rear portion 26 will substantially follow the track of front portion 22 when carving a turn.

in the first preferred embodiment shown in FIG. 6, bottom surface 18 is flat in repose, i.e., it has no camber. This configuration permits the variations in thickness of core 38 to be visualized most clearly. As is well-know in the art, snowboards are often designed so that the bottom surface 18 is upwardly arched (called a "camber") when unloaded. Snowboards having one or more cambers are certainly within the purview of the present invention.

Figure 10:
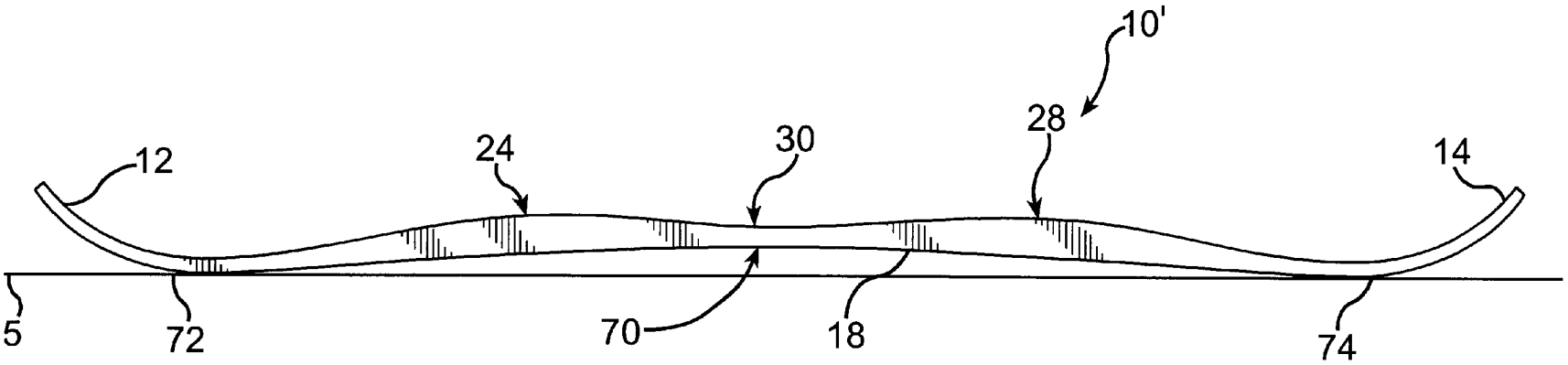
FIG. 10 is a side view of a snowboard which illustrates a second preferred embodiment of the present invention.
Figure 11:
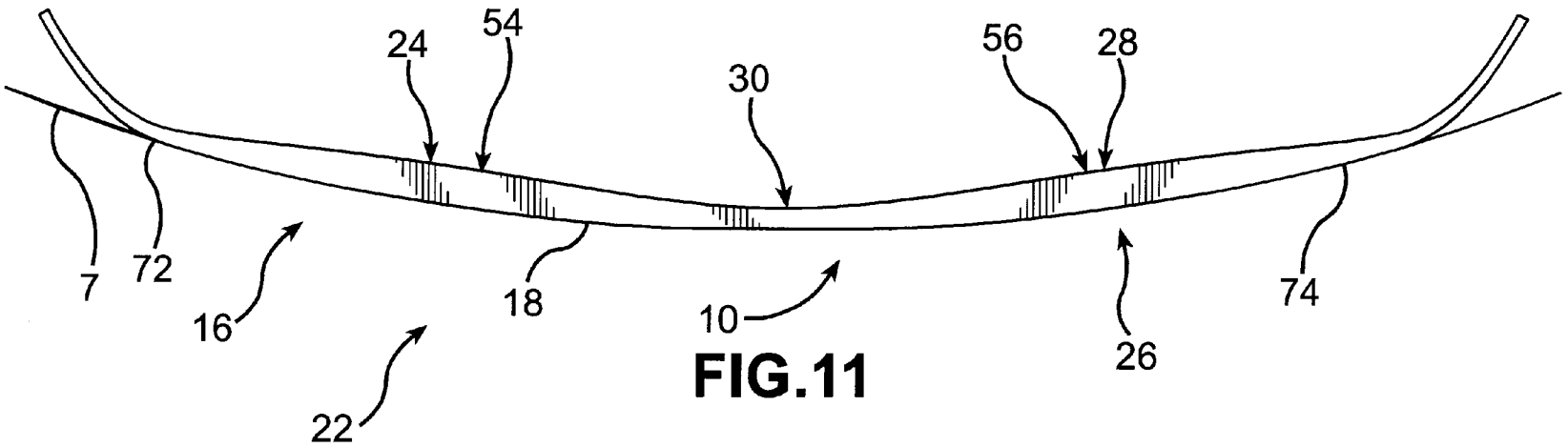
FIG. 11 is a side view of the preferred embodiment shown in FIG. 10 when under ideal loading conditions.

A second embodiment of a snowboard designed according to the method of the present invention is shown in FIGS. 10 and 11 and comprises a snowboard 10' with a single camber 70. As in the first embodiment, the thickness of core 38 (not shown) along the length of snowboard 10' is less in nose 12, center section 30, and tail 14 while being greater within front and rear mounting zones 24 and 28. In the quiescent state shown in FIG. 10, snowboard 10' rests on riding areas 72 and 74. When under the weight of the rider (FIG. 11), riding areas 72 and 74 are flattened and the direction of the camber is reversed, such that, as in the previous embodiment, bottom surface 18 is in contact with the snow coincident with an arc 7 of a circle. As before, this is due to proper selections of the area moments of inertia along the effective length 17 of body 16. Thus, when carving a turn, the rear portion 26 will track the front portion 22.

Figure 12:
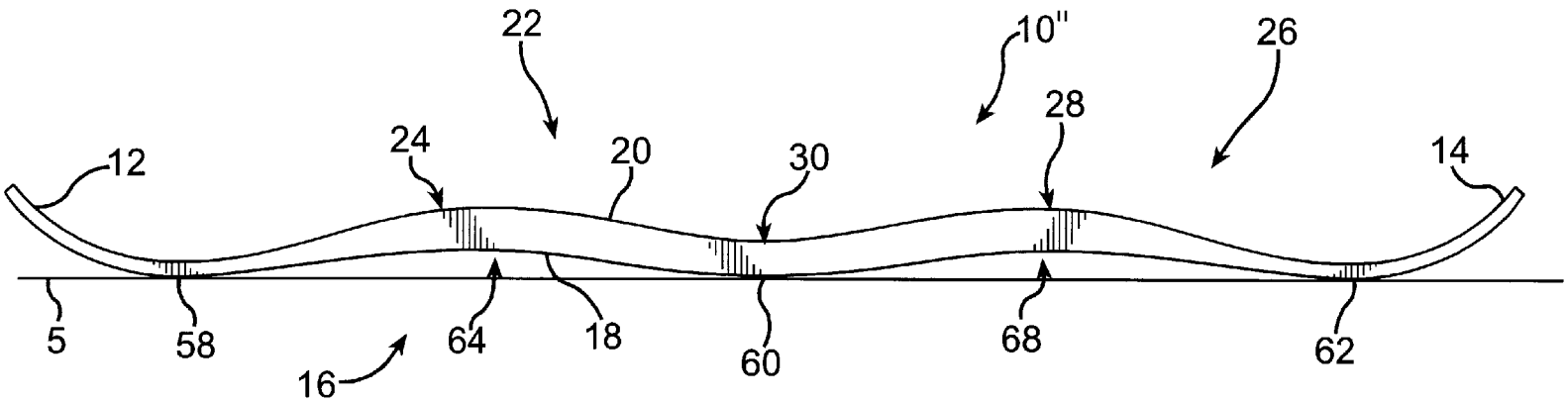
FIG. 12 is a side view of a snowboard which illustrates a third preferred embodiment of the present invention.
Figure 13:
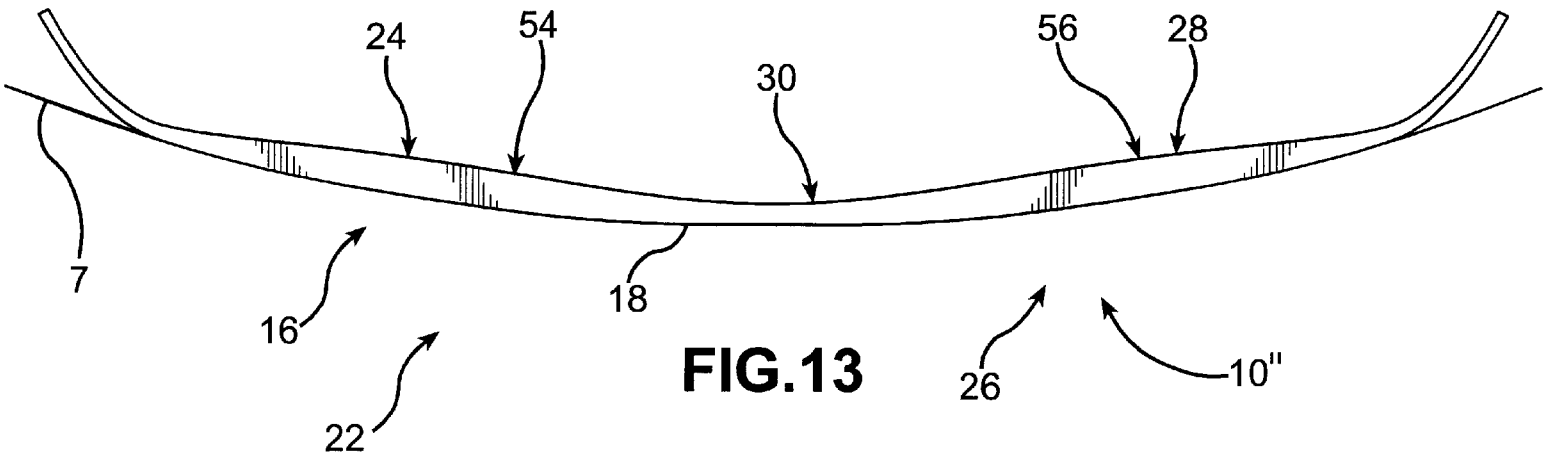
FIG. 13 is a side view of the preferred embodiment shown in FIG. 12 under ideal loading conditions.

FIGS. 12 and 13 show a third preferred embodiment designed in accordance with the method of the present invention comprising a snowboard 10" including dual cambers. The concept of providing a snowboard with dual cambers is the subject of my prior U.S. Pat. No. 5,823,562, assigned to the same assignee as the present invention, and specifically incorporated herein by reference. Dual cambers afford additional ease of control of snowboard 10", as discussed in my aforementioned patent. As in the first and second preferred embodiments, core 38 (not shown) of dual-cambered snowboard 10" is thinnest in the areas of nose 12 and tail 14, thinner in center section 30, and thickest under the rider's feet in front mounting zone 24 and rear mounting zone 28. In the quiescent state shown in FIG. 12, snowboard 10" rests on three riding areas 58, 60 and 62. When under the weight of the rider (FIG. 13), riding areas 58, 60 and 62 flatten and extend outwardly until, as in the previous embodiments, bottom surface 18 is in contact with the snow coincident with an arc 7 of a circle. As with the other embodiments, rear portion 26 will track front portion 22 when carving a turn.

It should be noted that under the principles described herein for designing snowboard 10 of FIG. 6 in accordance with the present invention, it is assumed that the bottom surface of snowboard 10 is flat when under no external loading. Adding a single or dual camber to a snowboard (FIGS. 10 and 12, respectively) will cause its bottom surface to bow into arcs which deviate slightly from a circular shape when under ideal loading conditions. However, such slight deviations will not noticeably detrimentally affect the turning performance of the snowboard.

D. Preferred Embodiment of Asymmetrical Snowboard

Figure 14:
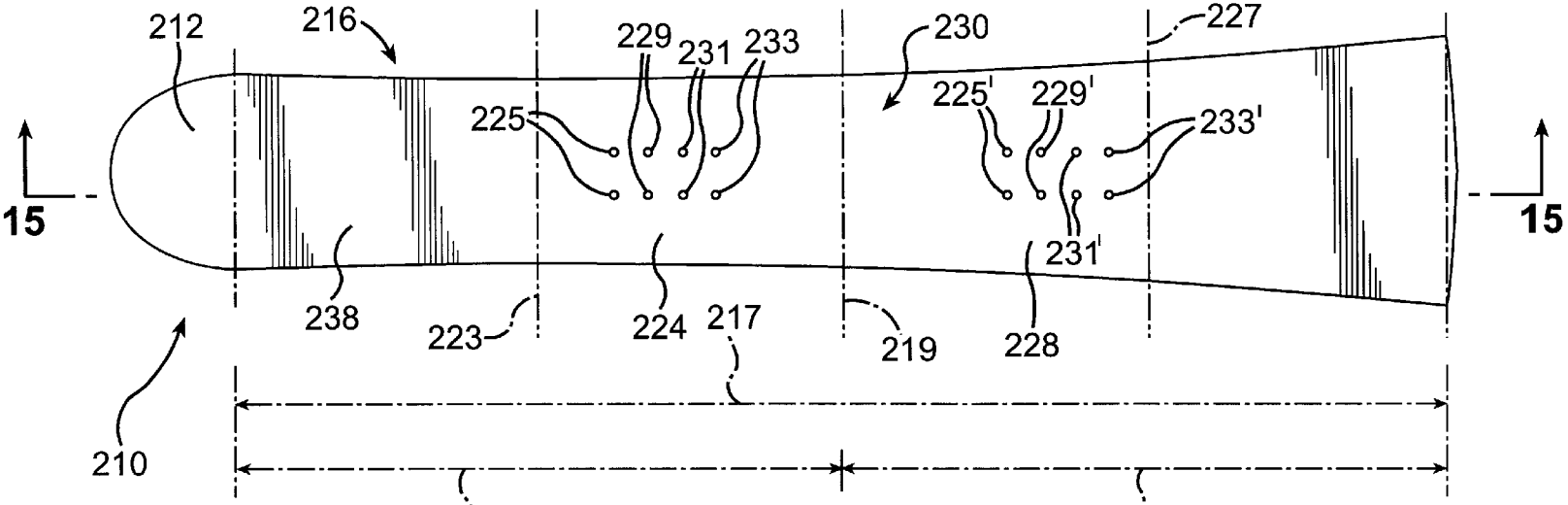
FIG. 14 is a top view of the core of a fourth preferred embodiment of the present invention.

In contrast to snowboard 10, which is longitudinally symmetrical, FIG. 14 shows a asymmetrical snowboard 210 designed in accordance with the method of the present invention. Snowboard 210 is a "freecarve" snowboard, which is a snowboard designed to be piloted nose-first and to be stable at high speeds.

FIG. 14 illustrates a top view of snowboard 210. In order to simplify FIGS. 14 and 15 and further illustrate the shape of a core designed in accordance with the present invention, only core 238 is shown; the core's cover, including a base, a cap, edges, and a lower structural layer are omitted. As with all snowboards designed in accordance with the method of the present invention, the core's cover is preferably of substantially uniform thickness along the length of snowboard 210.

As with snowboard 10 (see FIG. 6), snowboard 210 includes a body 216 from the forward and rearward extremities of which extend nose 212 and tail 214, respectively. An effective length 217 of body 216 is also represented in FIG. 14, a front portion 222, a rear portion 226, a front mounting zone 224, a rear mounting zone 228, and a central section 230. The midpoint of effective length 217 is indicated generally by dashed line 219, while the midpoints of front and rear portions 222 and 226 are respectively indicated by dashed lines 223 and 227.

As is conventional, snowboard 210 also includes a first set of threaded inserts 225, 229, 231, and 233 aligned across and embedded into the top of body 216 in front mounting zone 224. Similarly, a second set of threaded inserts 225', 229', 231' and 233' are aligned across and embedded into the top of body 216 in rear mounting zone 228.

As stated above, snowboard 210 is longitudinally asymmetrical. Body 216 of snowboard 210 gradually increases in width from the midpoint 219 rearwardly. This shape creates a "flared" rear portion 226, which enhances the stability of snowboard 210 at high speeds. In addition, the "stance width" of snowboard 210, i.e, the distance between front mounting zone 224 and rear mounting zone 228, is preferably narrower than the stance width of snowboard 10. The primary reason for the narrowed stance is to compensate for the fact that the boots of the rider of a freecarve snowboard are ordinarily more forwardly oriented than the boots of the rider of a freestyle snowboard. Furthermore, front mounting zone 224 of snowboard 210 is shifted slightly further rearward from the midpoint 223 of front portion 220 as compared to the front mounting zone 24 of snowboard 10.

Figure 15:
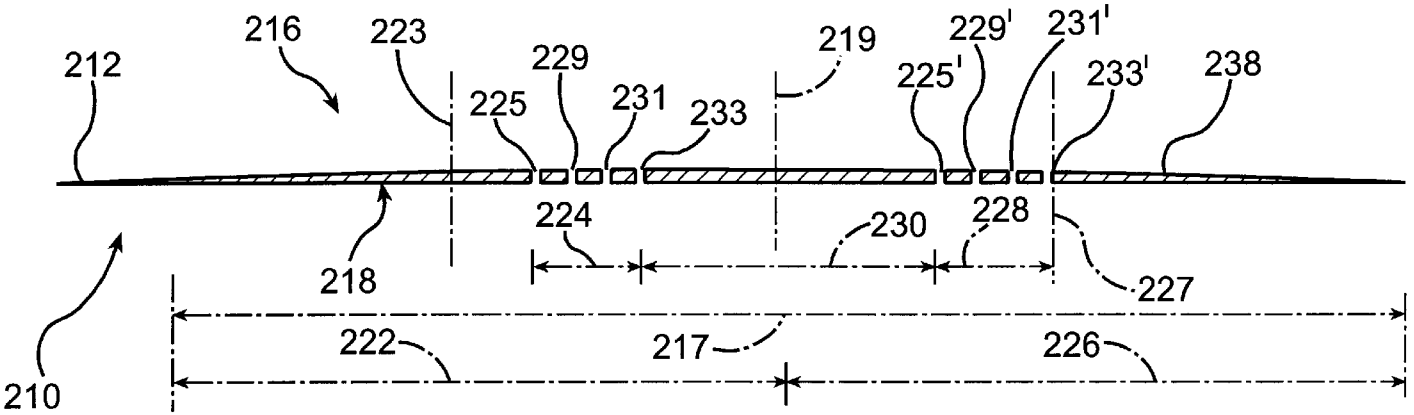
FIG. 15 is a longitudinal sectional view of the fourth embodiment taken along line 15—15 of FIG. 14.

Referring now to FIG. 15, there is illustrated a longitudinal sectional view, taken along line 15—15 of FIG. 14, of snowboard 210 in an unloaded state. Core 238 is drawn substantially to scale in FIG. 15 in order to show the relative dimensions of a core designed in accordance with the present invention. In addition, core 238 is shown having a flat bottom surface 218, i.e., with no camber and with nose 212 and tail 214 not being upwardly curved. As is well-known in the art, the desired camber of bottom surface 218 (i.e., a single camber or dual camber) and the upward curvature of nose 212 and tail 214 are achieved by bonding the elements of the core's cover to core 238 within a curved form.

As with snowboard 10, snowboard 210 is designed so as to be capable of bowing into substantially circular arcs during turns. As before, this is accomplished by applying the above-described method to select appropriate area moments of inertia for numerous transverse cross-sections of snowboard 210, so that under ideal loading conditions snowboard 210 will be capable of bowing into substantially circular arcs.

Figure 16:
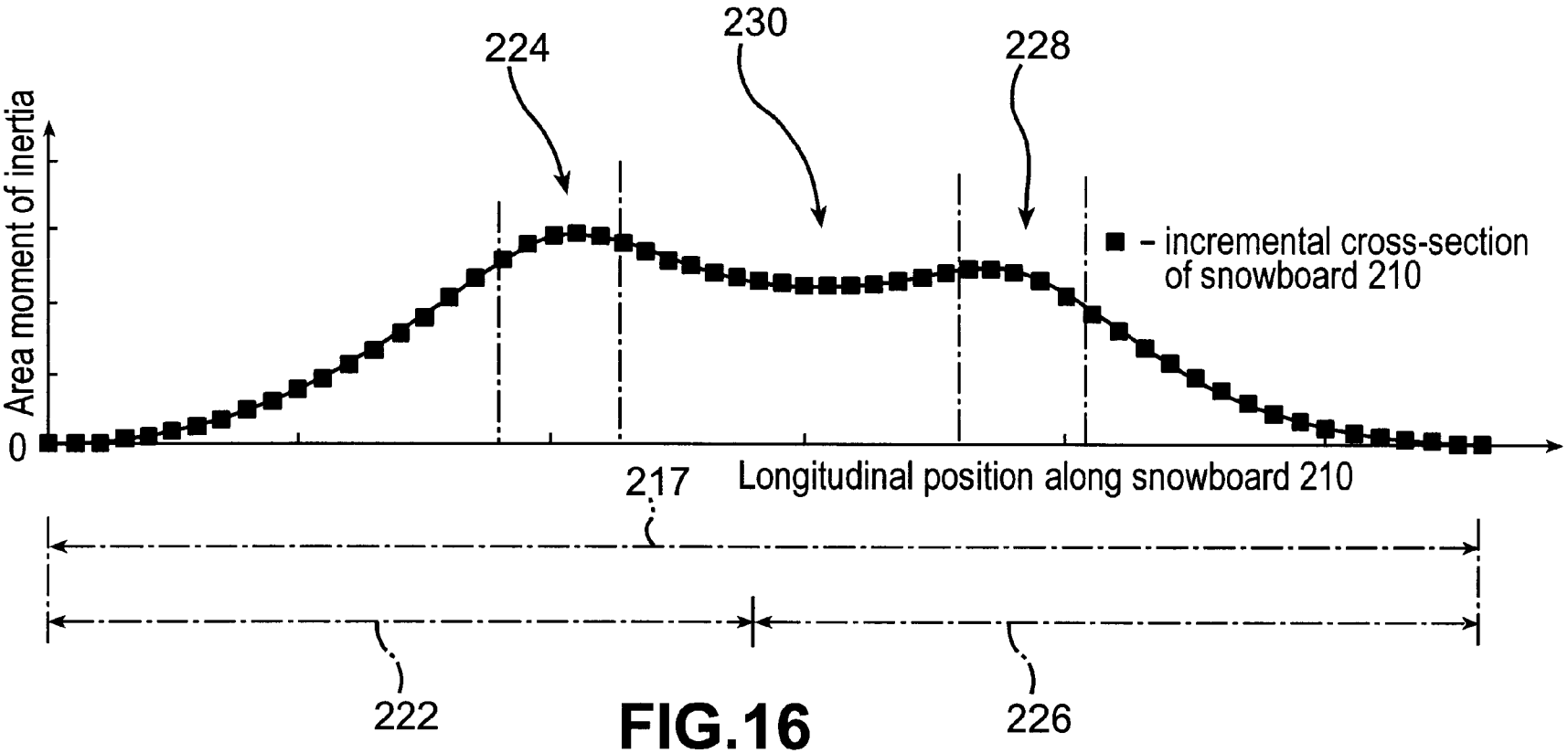
FIG. 16 is a graph showing area moments of inertia of a set of incremental cross-sections of the fourth embodiment of the present invention.

FIG. 16 is a graph showing a typical plot of relative area moments of inertia for a set of incremental cross-sections of snowboard 210 calculated in accordance with the method of the present invention. Area moments of inertia are plotted on the vertical axis and the location of each incremental cross-section along effective length 217 of body 16 on the horizontal axis. As with snowboard 10, FIG. 16 illustrates that using the method of the present invention to select the thickness of core 238 of snowboard 210 at incremental cross-sections results in an average area moment of inertia within front and rear mounting zones 224 and 228 which is greater than the average area moment of inertia within center section 230.

It must again be borne in mind that the graph shown in FIG. 16 represents the area moments of inertia for the cross-sections of snowboard 210, including core 238 and all cover components, because it is the total or composite area moment of inertia at each cross-section that determines the flexibility of snowboard 210 at that cross-section. However, since the cover elements are preferably substantially uniform in thickness, the area moment of inertia for core 238 at a given crosssection is roughly proportional to the total area moment of inertia snowboard 210 at that same cross-section.

Returning now to FIG. 15, the average cross-sectional thickness of core 238 is greater in front mounting zone 224 than in center section 238. However, unlike snowboard 10, the average cross-sectional thickness of core 238 in rear mounting zone 228 is less than in center section 230. This is due to the fact that core 238 is considerably wider within rear mounting zone 228 than within center section 230. Thus, a lesser thickness of core 238 is required to achieve the desired area moments of inertia at each incremental cross-section.

E. Alternate Embodiments of Core Cross-Sections

In accordance with the present invention, as explained above, a plurality of cross-sectional thicknessess of the core 38 are selected in order to design a snowboard which exhibits the desired curvature under ideal loading conditions. A typical cross-section through a snowboard designed according to the present invention may, for example, resemble those shown in FIGS. 2–5 (which cross-sections happen to be taken transversely across the rear mounting zone 28 of FIG. 1). Although such cross-sectional shapes are themselves individually conventional, in the present invention as discussed below, the cross-sectional shape of the core preferably varies smoothly and gradually from cross-section to cross-section.

FIGS. 17–23 illustrate several possible general cross-sectional shapes that may be found in the core 38 of the present invention. These cross-sectional shapes are presented to demonstrate that different cross sectional shapes of the core can have essentially equivalent moments of inertia I. Of course, the cross-sectional core shapes shown in FIGS. 17–23 are merely illustrative of the possibilities and are not exhaustive of the shapes contemplated as falling within the scope of the present invention. Also, although described herein in the context of the symmetrical snowboard embodiments (§C, supra), it should be understood that FIGS. 17–23 may also be found in asymmetrical snowboards according to the present invention. One operative relationship, it is recalled, is that the cross-sectional thickness of the core varies smoothly and gradually along the length of the snowboard from within and including the mounting zones through the center section so that the average cross-sectional thickness in the center section is less than that in at least one of the mounting zones (i.e., asymmetrical snowboard) and is less than that in both of the mounting zones (i.e., symmetrical snowboard).

Figure 17:
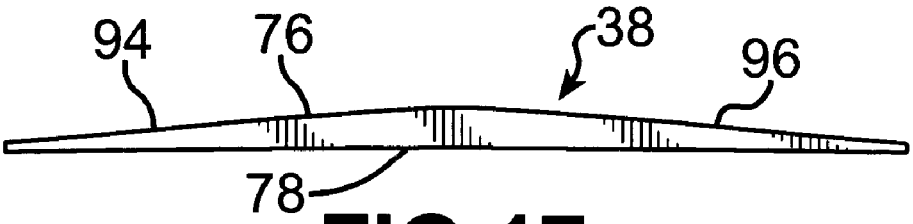
FIGS. 17–23 illustrate a few examples of acceptable alternatives of the geometry of the cross-sectional area of the core which fall within the scope of the present invention.
Figure 18:
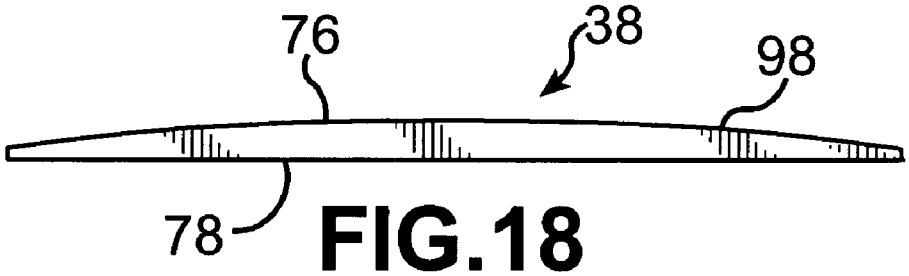
Figure 19:
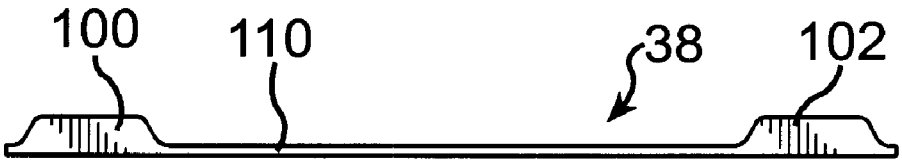

More particularly, FIGS. 17–19 illustrate alternate preferred embodiments of cross-sectional shapes of core 38 of the present invention which may be found anywhere along the snowboard, i.e., either within mounting zones 24 and 28 or outside the mounting zones. FIGS. 17–19 show cross-sectional shapes each of which has substantially the same moment of inertia and which comprise essentially rectangular core cross-sections having a flat top surface 76, a flat bottom surface 78, and mirror-image sides 80, 82 and 84, respectively.

Sides 80 in FIG. 17 are at right angles to top and bottom surfaces 76 and 78, which are parallel to each other; this core shape is the simplest to manufacture. Sides 82 in FIG. 18 comprise sloping portions 86 merging into vertical portions 88. Sides 84 in FIG. 19 are more stylized, combining an arcuate portion 90 sloping from top surface 76 to a vertical edge 92. The latter two are shaped more for aesthetic reasons than functional ones, although the smoother edges aid in protecting cap 40 (see FIGS. 2–5) from stress-related tears.

Each shape of the cross-sections of the cores shown in FIGS. 20–23 also have substantially the same area moment of inertia. FIGS. 20–23 represent alternate possible cross-sections which preferably can occur either between mounting zone 24 and nose 12, or in central section 30, or between mounting zone 28 and tail 14. In other words, the cross-sectional shapes in FIGS. 20–23 are preferably not formed in mounting zones 24 or 28, since the top surface 76 should be substantially flat in the mounting zones in order to provide adequate support for the foot bindings. Thus, the shapes of FIGS. 17–19 are preferred for the mounting zones.

Figure 20:
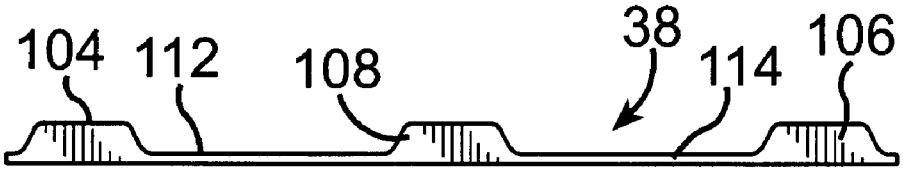
Figure 21:
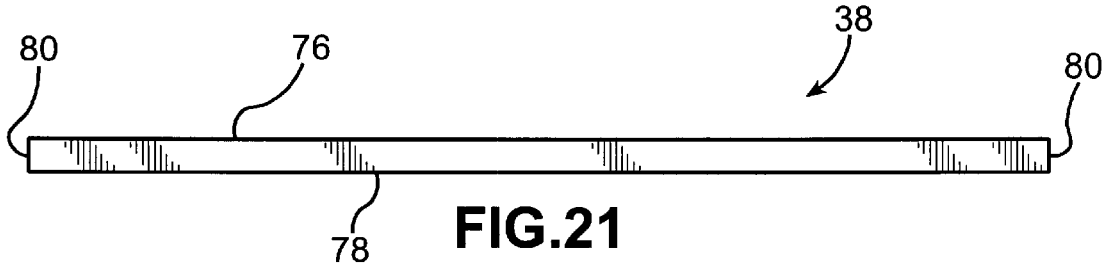

Alternatively, the sloping top surfaces 94 and 96 of FIG. 20 and the arcuate surface 98 of FIG. 21 can extend the length of the snowboard, but those configurations require the bindings be shaped to conform thereto while maintaining the boots' bottoms parallel to bottom surfaces 78.

Figure 22:
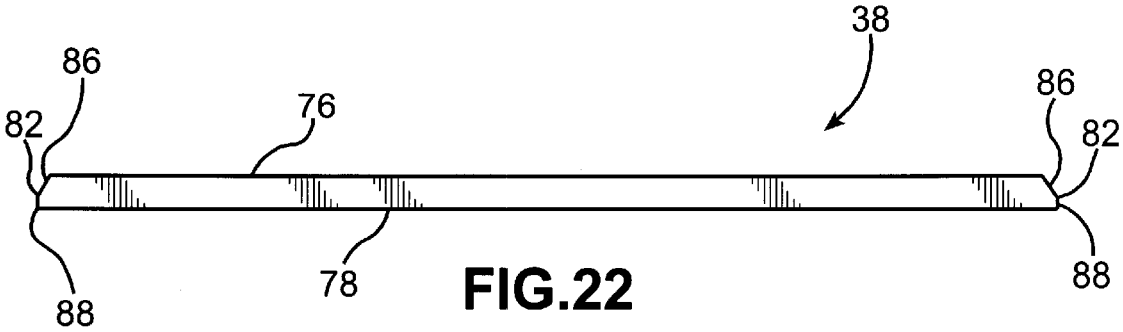
Figure 23:
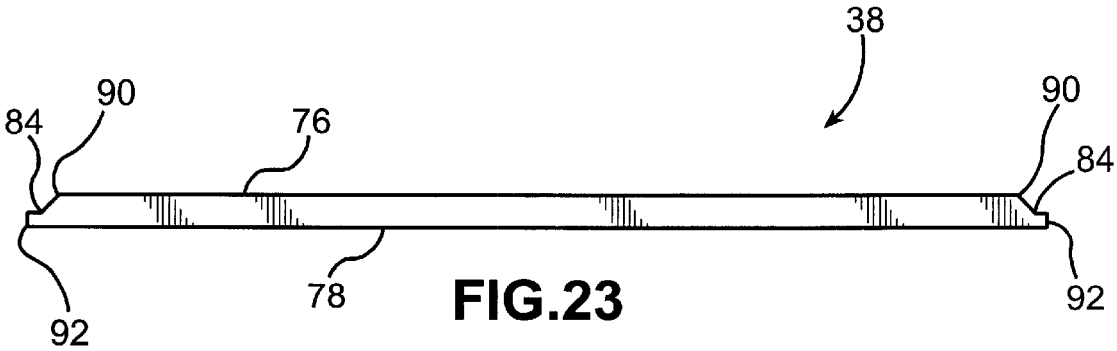
Figure 24:
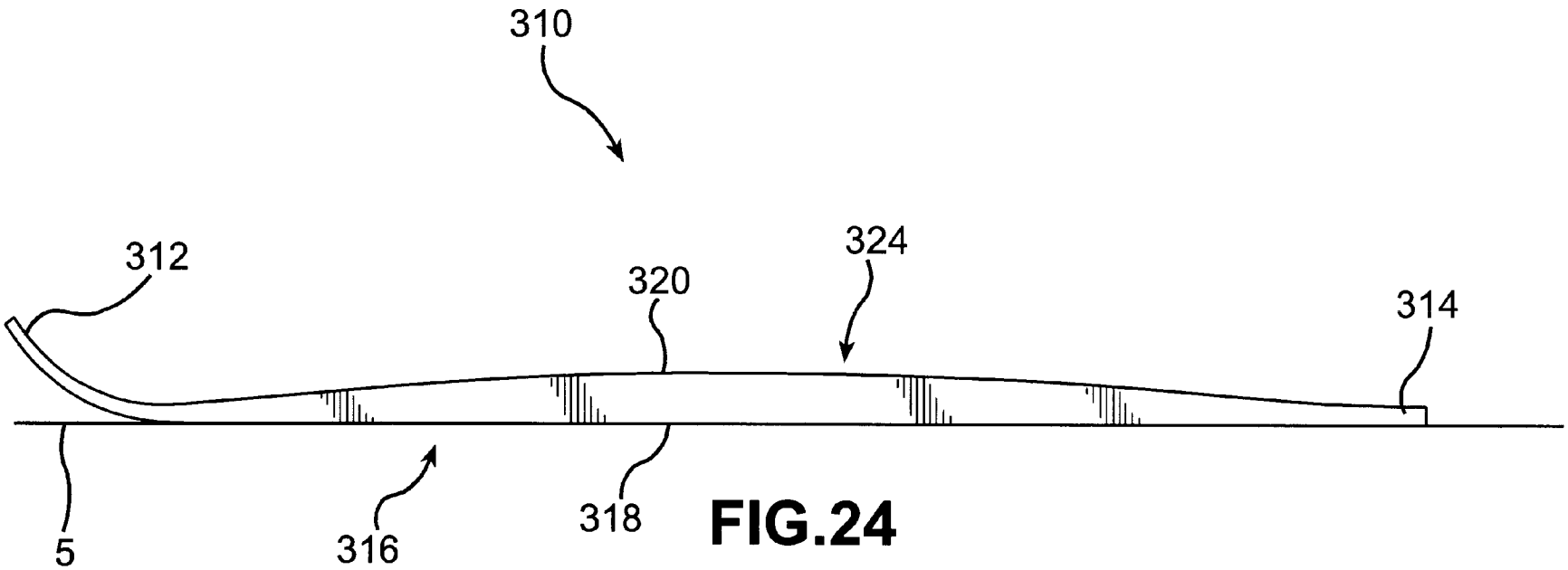
FIG. 24 is a side view of a conventional ski.

FIGS. 22 and 23 illustrate cross-sectional shapes which are designed to increase torsional flexibility of snowboard 10 while maintaining the correct longitudinal flexibility of the snowboard. Ridges 100 and 102 of FIG. 22 and ridges 104 and 106 of FIG. 23.may extend along the full length of the sides of snowboard 10. Ridge 108 (FIG. 23), which may extend along substantially the full length of center section 30, adds strength longitudinally to the central axis thereof. Thinner sections 110, 112, and 114 are formed between ridges 100–102, 104–108, and 108–106, respectively. The thinner sections 110–114 reduce the weight of snowboard 10 (compared to boards having the cross-sections of FIGS. 17–19), and they permit increased torsional flexibility in the portions of the snowboard in which they are present.

Preferably, in accordance with the symmetrical embodiments of the present invention, if used in a snowboard the cross-sectional core shapes shown in FIGS. 20–23 would merge gradually and smoothly into the cross-sectional shapes of FIG. 17 (for FIGS. 20 or 21) or FIG. 19 (for FIGS. 22 or 23) in the areas of mounting zones 24 and 28. In other words, for example, if a cross-sectional shape such as shown in FIG. 22 were used in center section 30, then the central thinner section 110 would smoothly and gradually increase in thickness towards one or both mounting zones until a substantially rectangular cross-section, of the same general shape as shown, for example, in FIG. 19, were achieved in the respective mounting zones.

In some snowboards, the cross-sectional shapes of core 38 shown in FIGS. 20–23 may be desirable from the standpoint of determining its torsional characteristics. However, such cross-sectional shapes add complexity (and cost) to the process of designing and manufacturing snowboard 10 so that it bows into a desired shape under ideal loading conditions. Also, the process of calculating the average cross-sectional thickness of the cross-sections shown in FIGS. 20–23 would require the area of each cross-section to be determined and then divided by its width, which is a more complex process than determining the cross-sectional thickness of the shapes shown in FIGS. 17–19 (each of which has a substantially constant thickness across its respective width). Thus, the preferred shape of core 38 is one of generally uniform thickness across each transverse cross-section, such as those shown in FIGS. 17–19.

It may now be appreciated that one relationship discovered by applying the teachings of the present invention, i.e., that the average cross-sectional thickness in the center section is at least thinner than that of one of the mounting zones (e.g., asymmetrical embodiments), or is thinner than that of both mounting zones (e.g., symmetrical embodiments), may be expressed slightly more broadly as follows. In designing a symmetrical snowboard capable of bowing into circular arcs during turns, the average cross-sectional area in the center section is thinner than the average cross-sectional area in either of the foot mounting zones. In designing an asymmetrical snowboard to bow into circular arcs during turns, the average cross-sectional area in the center section is thinner than the average cross-sectional area at least one of the foot mounting zones.

It may also be said that, in view of FIGS. 7 and 16, that an operative relationship resulting from applying the present invention is that the average cross-sectional area moment of inertia of the core in the center section of the snowboard is less than that in at least one of the front and rear mounting zones, and may be less than that in both mounting zones.

F. Conclusion

It is clear from the above that the objects of the invention have been fulfilled.

Those skilled in the art will appreciate that the conceptions, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention as defined in the appended claims.

Further, the purpose of the Abstract is to enable the public, especially the scientists, engineers and practitioners in the art who are not familiar with patent or legal terms or phraseology, to determine quickly from a cursory inspection the nature and essence of the technical disclosure of the application. The Abstract is neither intended to define the invention, which is measured solely by the claims, nor is intended to be limiting as to the scope of the invention in any way.

I claim as my invention:

1. A method of designing and making a snowboard or ski body having a number of parts including a cap, a base, and a core, said body being partitioned into a plurality of cross-sectional portions, said cap having a top surface and a first mounting zone located on said top surface for mounting a first snowboard binding, said base having a bottom surface, said core having a thickness, wherein said method comprises the steps of:

(1) selecting a loading condition comprising a first downward load acting on said first mounting zone and an upward force acting on said bottom surface and selecting a desired curvature of said bottom surface under said loading condition;

(2) determining said thickness of said core at one of said cross-sectional portions, so that the following equation is satisfied;

$$I=M/(EC_m)$$

where:

$C_m$ is said desired curvature of said bottom surface under said loading condition at said one of said cross-sectional portions;

E is the composite modulus of elasticity of said body at said one of said cross-sectional portions;

I is the composite area moment of inertia of said body at said one of said cross-sectional portions;

M is the bending moment acting on said one of said cross-sectional portions under said loading condition;

(3) repeating step (2) for each of said plurality of cross-sectional portions; and manufacturing a snowboard wherein said thickness of said core at each of said plurality of cross-sectional portions corresponds to the thicknesses determined in steps (2) and (3).

2. The method of claim 1, wherein said body further includes a second mounting zone located on said top surface for mounting a second snowboard binding and said loading condition further comprises a second downward load acting on said second mounting zone.

3. The method of claim 2, wherein said first and second downward loads are equal in magnitude.

4. The method of claim 2, wherein the magnitude of said first downward load is larger than the magnitude of said second downward load.

5. The method of claim 1, wherein said upward force is uniformly distributed along said bottom surface.

6. The method of claim 1, further comprising the step of selecting the relative position, materials and dimensions of said parts of said body, except for said thickness of said core, prior to step (2).

7. The method of claim 1, wherein said desired curvature, $C_m$, of said bottom surface under said loading condition is selected from the group consisting of: a circular arc and a parabolic arc.

8. The method of claim 1, wherein said desired curvature, $C_m$, of said bottom surface under said loading condition comprises a circular arc.

* * * * *